US010954722B2

(12) United States Patent
Bradford, III et al.

(10) Patent No.: US 10,954,722 B2
(45) Date of Patent: Mar. 23, 2021

(54) FIXED CUTTER DRILL BITS INCLUDING NOZZLES WITH END AND SIDE EXITS

(71) Applicant: National Oilwell DHT, L.P., Conroe, TX (US)

(72) Inventors: John Francis Bradford, III, The Woodlands, TX (US); Navid Omidvar, The Woodlands, TX (US); Reza Rahmani, Spring, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 68 days.

(21) Appl. No.: 16/065,652

(22) PCT Filed: Jan. 20, 2017

(86) PCT No.: PCT/US2017/014351

§ 371 (c)(1),
(2) Date: Jun. 22, 2018

(87) PCT Pub. No.: WO2017/127688

PCT Pub. Date: Jul. 27, 2017

(65) Prior Publication Data

US 2019/0003262 A1 Jan. 3, 2019

Related U.S. Application Data

(60) Provisional application No. 62/281,461, filed on Jan. 21, 2016.

(51) Int. Cl.

| | |
|---|---|
| ***E21B 10/60*** | (2006.01) |
| ***E21B 41/00*** | (2006.01) |
| ***E21B 10/43*** | (2006.01) |

(52) U.S. Cl.

CPC ..... *E21B 10/602* (2013.01); *E21B 10/43* (2013.01); *E21B 41/0078* (2013.01)

(58) Field of Classification Search

CPC ..... E21B 10/60; E21B 10/602; E21B 10/61; E21B 41/0078; E21B 2010/607

See application file for complete search history.

(56) References Cited

U.S. PATENT DOCUMENTS 1,661,672 A * 3/1928 Morrison ..... E21B 7/18 175/424

3,744,581 A 7/1973 Moore (Continued)

FOREIGN PATENT DOCUMENTS

EP 0959224 A2 11/1999
WO 2016/161028 A1 10/2016

OTHER PUBLICATIONS

PCT/US2017/014351 International Search Report and Written Opinion dated Apr. 12, 2017 (14 p.).

(Continued)

*Primary Examiner* — D. Andrews
(74) *Attorney, Agent, or Firm* — Conley Rose, P.C.

(57) ABSTRACT

A drill bit includes a bit body and an internal plenum in the bit body. In addition, the drill bit includes a first flow passage extending from the internal plenum to a bit face. Still further, the drill bit includes a nozzle assembly secured to the bit body at a downhole end of the flow passage. The nozzle assembly has a central axis and includes an outer sleeve and an inner nozzle extending axially through the outer sleeve. The inner nozzle has a first end, a second end opposite the first end, and a radially inner surface extending axially from the first end to the second end. The radially inner surface defines a second flow passage. The inner nozzle also includes a choke disposed along the second flow passage and a side outlet extending radially from the outer surface to the inner surface.

25 Claims, 19 Drawing Sheets

(56) References Cited

U.S. PATENT DOCUMENTS

| | | | | |
|---|---|---|---|---|
| 3,823,789 | A * | 7/1974 | Garner | E21B 10/18 175/340 |
| 4,723,612 | A | 2/1988 | Hicks | |
| 4,784,231 | A | 11/1988 | Higgins | |
| 5,553,678 | A | 9/1996 | Barr et al. | |
| 5,579,855 | A | 12/1996 | Dickey | |
| 6,029,756 | A * | 2/2000 | Britzke | E21B 10/61 175/57 |
| 6,082,473 | A | 7/2000 | Dickey | |
| 6,581,702 | B2 | 6/2003 | Dickey | |
| 6,585,063 | B2 | 7/2003 | Larsen | |
| 7,748,478 | B2 | 7/2010 | Swadi | |
| 7,770,671 | B2 | 8/2010 | Patel | |
| 8,342,266 | B2 | 1/2013 | Hall et al. | |
| 9,951,567 | B2 | 4/2018 | De Maindreville et al. | |
| 2002/0148649 | A1 | 10/2002 | Dickey | |
| 2010/0270086 | A1 | 10/2010 | Matthews, III et al. | |
| 2014/0090888 | A1 | 4/2014 | Smith et al. | |
| 2014/0216761 | A1 | 8/2014 | Trinh | |
| 2015/0368979 | A1* | 12/2015 | Casad | E21B 10/02 175/57 |
| 2016/0076309 | A1 | 3/2016 | Cuillier De Maindreville et al. | |

OTHER PUBLICATIONS

European Search Report dated Aug. 21, 2019, for European Application No. 17742018.9 (8 p.).

* cited by examiner

FIXED CUTTER DRILL BITS INCLUDING NOZZLES WITH END AND SIDE EXITS

CROSS-REFERENCE TO RELATED APPLICATIONS

This application is a 35 U.S.C. § 371 national stage application of PCT/US2017/014351 filed Jan. 20, 2017, and entitled "Fixed Cutter Drill Bits Including Nozzles with End and Side Exits," which claims benefit of U.S. provisional patent application Ser. No. 62/281,461 filed Jan. 21, 2016, and entitled "Fixed Cutter Drill Bits Including Nozzles with End and Side Exits," each of which is hereby incorporated herein by reference in its entirety for all purposes.

BACKGROUND

The present disclosure relates generally to earth-boring bits used to drill a borehole for the ultimate recovery of oil, gas or minerals. More particularly, the disclosure relates to fixed cutter drill bits with improved hydraulics. Still more particularly, the disclosure relates to drilling fluid nozzles including end and side outlets for use with fixed cutter drill bits.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill wellbores. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The drilling fluid exiting the face of the bit through nozzles or ports performs several functions. In particular, the fluid removes formation cuttings (e.g., rock chips) from the cutting structure of the drill bit. Otherwise, accumulation of formation cuttings on the cutting structure may reduce or prevent the penetration of the drill bit into the formation. In addition, the fluid removes formation cuttings from the bottom of the hole. Failure to remove formation materials from the bottom of the hole may result in subsequent passes by cutting structure to essentially re-cut the same materials, thereby reducing the effective cutting rate and potentially increasing wear on the cutting surfaces of the cutter elements. The drilling fluid flushes the cuttings removed from the bit face and from the bottom of the hole radially outward and then up the annulus between the drill string and the borehole sidewall to the surface. Still further, the drilling fluid removes heat, caused by contact with the formation, from the cutter elements to prolong cutter element life. Thus, the positioning of the drilling fluid nozzles in the drill bit and the resulting flow of drilling fluid from the nozzles may significantly impact the performance of the drill bit.

BRIEF SUMMARY OF THE DISCLOSURE

Embodiments of drill bits for drilling in earthen formations are disclosed herein. In one embodiment, the drill bit has an uphole end and a downhole end. In addition, the drill bit comprises a bit body having a bit face disposed at the downhole end. Further, the drill bit comprises an internal plenum extending from the uphole end into the bit body. Still further, the drill bit comprises a first flow passage extending from the internal plenum to the bit face. Moreover, the drill bit comprises a nozzle assembly secured to the bit body at a downhole end of the flow passage. The nozzle is configured to distribute drilling fluid about the bit face. The nozzle assembly has a central axis and comprises an outer sleeve and an inner nozzle extending axially through the outer sleeve. The inner nozzle has a first end, a second end opposite the first end, a radially outer surface extending axially from the first end to the second end, and a radially inner surface extending axially from the first end to the second end. The radially inner surface defines a second flow passage extending axially from the first end to the second end. The second flow passage has an inlet at the first end and an outlet at the second end. The inner nozzle comprises a choke disposed along the second flow passage and a side outlet extending radially from the outer surface to the inner surface. The side outlet extends axially from the outlet. The side outlet extends axially across at least a portion of the choke.

Embodiment of nozzle assemblies for distributing drilling fluid from a drill bit are disclosed herein. In one embodiment, the nozzle assembly has a central axis and comprises a sleeve having a first end, a second end, a radially outer surface extending axially from the first end to the second end, and a radially inner surface extending axially from the first end to the second end. The radially inner surface defines a throughbore extending axially through the sleeve. In addition, the nozzle assembly comprises a nozzle disposed in the throughbore of the sleeve. The nozzle has a first end proximal the first end of the outer sleeve, a second end opposite the first end of the nozzle, a radially outer surface extending axially from the first end of the nozzle to the second end of the nozzle, and a radially inner surface extending axially from the first end of the nozzle to the second end of the nozzle. The radially inner surface of the nozzle defines a flow passage extending axially through the nozzle. The flow passage has an inlet at the first end of the nozzle and an outlet at the second end of the nozzle. The flow passage includes a choke. The nozzle also includes a side outlet extending radially from the outer surface of the nozzle to the inner surface of the nozzle. The side outlet extends axially from the second end and is contiguous with the outlet. The choke at least partially overlaps with the side outlet and is configured to direct at least a portion of the drilling fluid flowing through the flow passage toward the side outlet.

Embodiment of nozzles for distributing drilling fluid from a drill bit for distributing drilling fluid from a drill bit are disclosed herein. In one embodiment, the nozzle has a central axis and comprises a first end, a second end opposite the first end, a radially outer surface extending axially from the first end to the second end, and a radially inner surface extending axially from the first end to the second end. The radially inner surface defines a flow passage extending through the nozzle from the first end to the second end. The flow passage has an inlet at the first end and an outlet at the second end. The flow passage includes a section extending from the outlet. In addition, the nozzle comprises a side outlet extending radially from the outer surface to the inner surface. The side outlet extends axially from the second end and is contiguous with the outlet. The section of the flow passage at least partially overlaps with the side outlet. A tangent to the central axis of the flow passage in the section is oriented at an acute angle $\sigma$ relative to the central axis of the nozzle. The section of the flow passage is configured to direct at least a portion of the drilling fluid flowing through the flow passage toward the side outlet.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
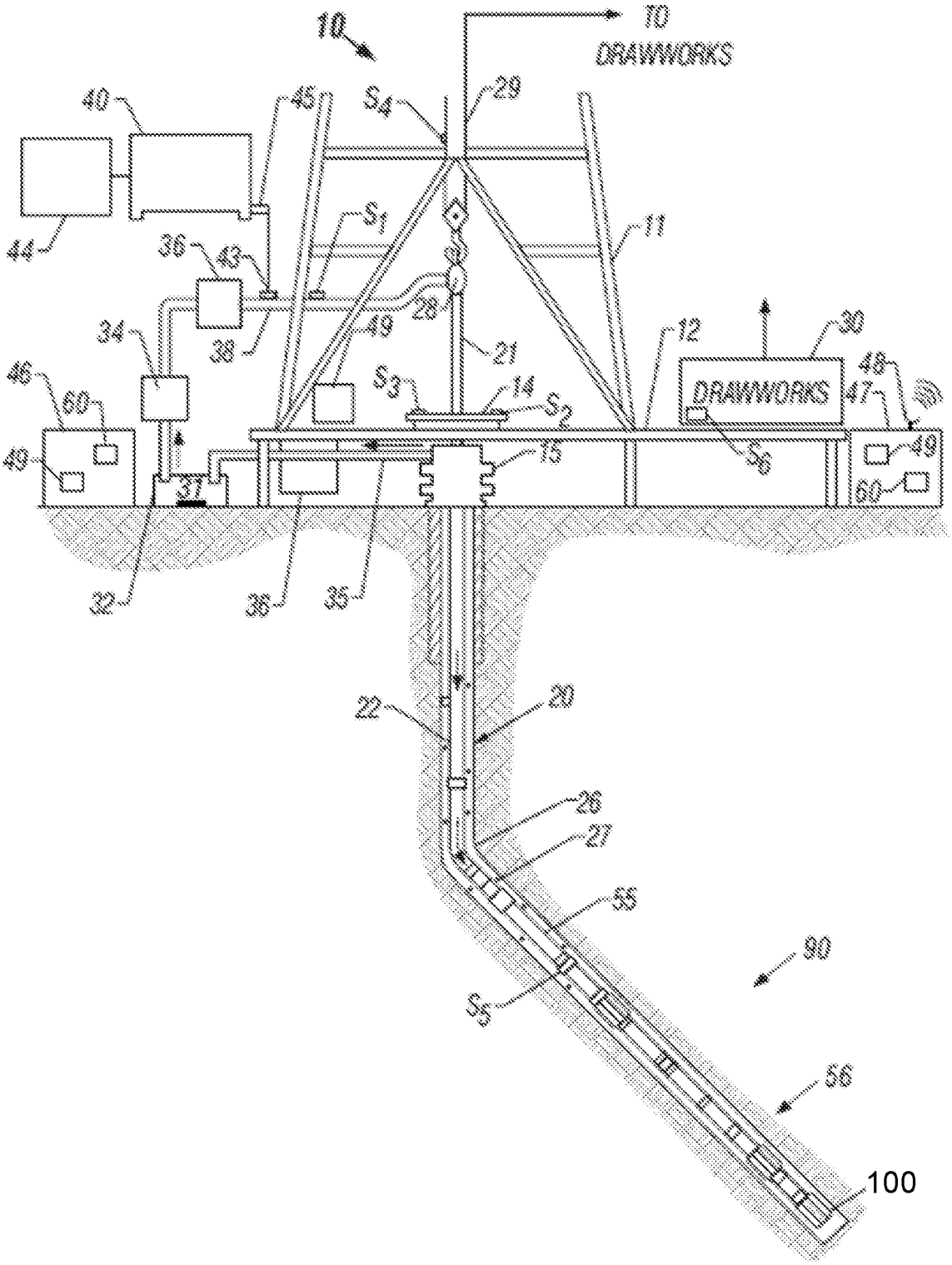
FIG. 1 is a schematic view of a drilling system including an embodiment of a drill bit in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is desirable to employ drill bits which will drill faster and longer.

The length of time that a drill bit may be employed before it must be changed depends upon a variety of factors. These factors include the bit's rate of penetration ("ROP"), as well as its durability or ability to maintain a high or acceptable ROP. One factor that significantly affects bit ROP and durability is the bit hydraulics—the design and layout of the nozzles in the bit face that direct the flow and direction drilling fluid as it exits the bit body. For example, when formation cuttings adhere to the bit between the cutting elements, they can undesirably limit the penetration of the individual cutting elements into the formation, thereby reducing the amount of formation material removed by the cutter elements and associated reduction in rate of penetration (ROP). In addition, formation cuttings packed on the bit may restrict or limit the flow of drilling fluid to the cutter elements, which may promote premature bit wear. In general, having sufficient fluid directed toward the cutter elements can help to clean and cool the cutter elements, allowing them to penetrate to a greater depth and maintain the rate of penetration for the bit. Thus, cuttings must be removed efficiently during drilling to maintain reasonable penetration rates.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
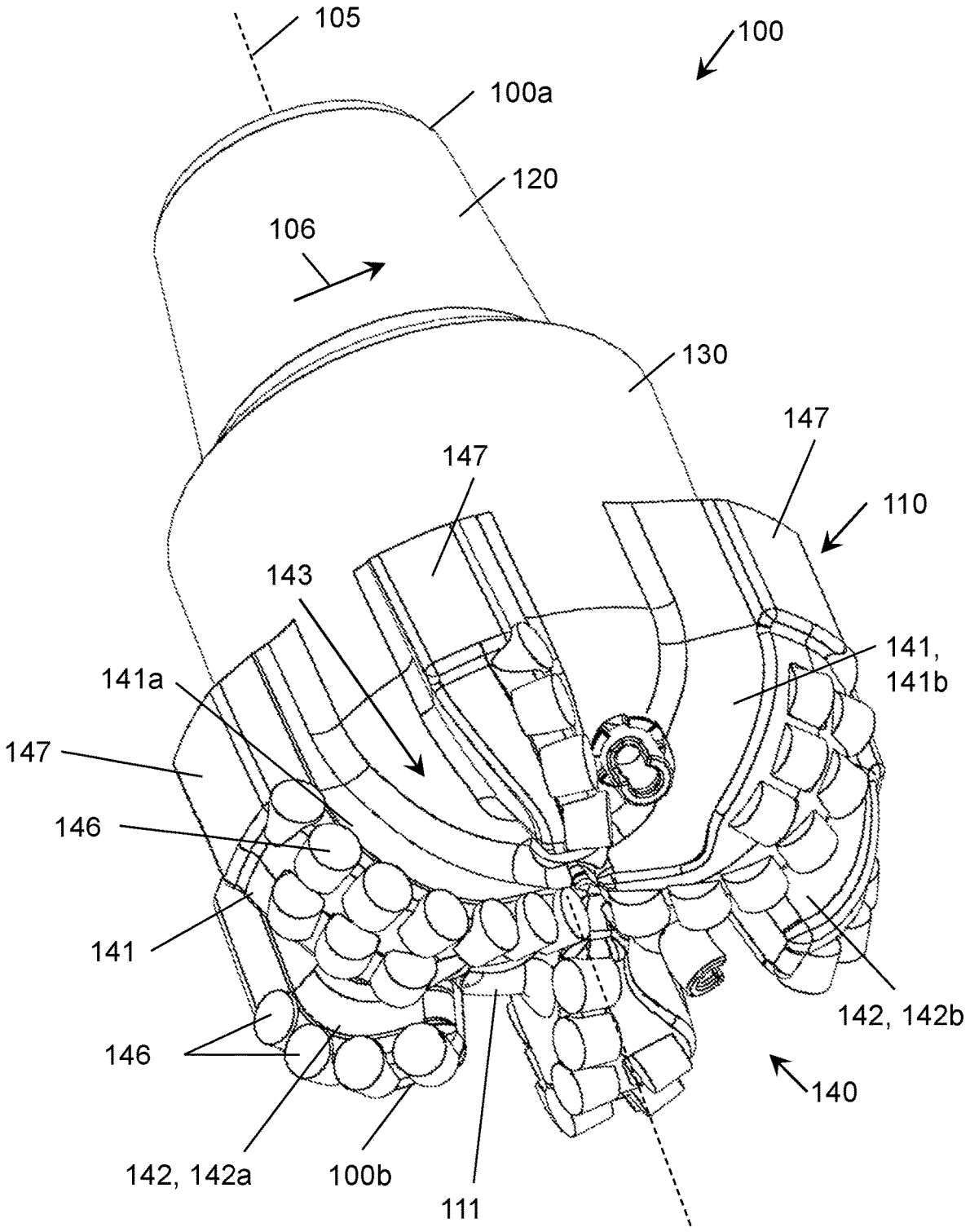
FIG. 2 is a perspective view of the drill bit of FIG. 1.
Figure 3:
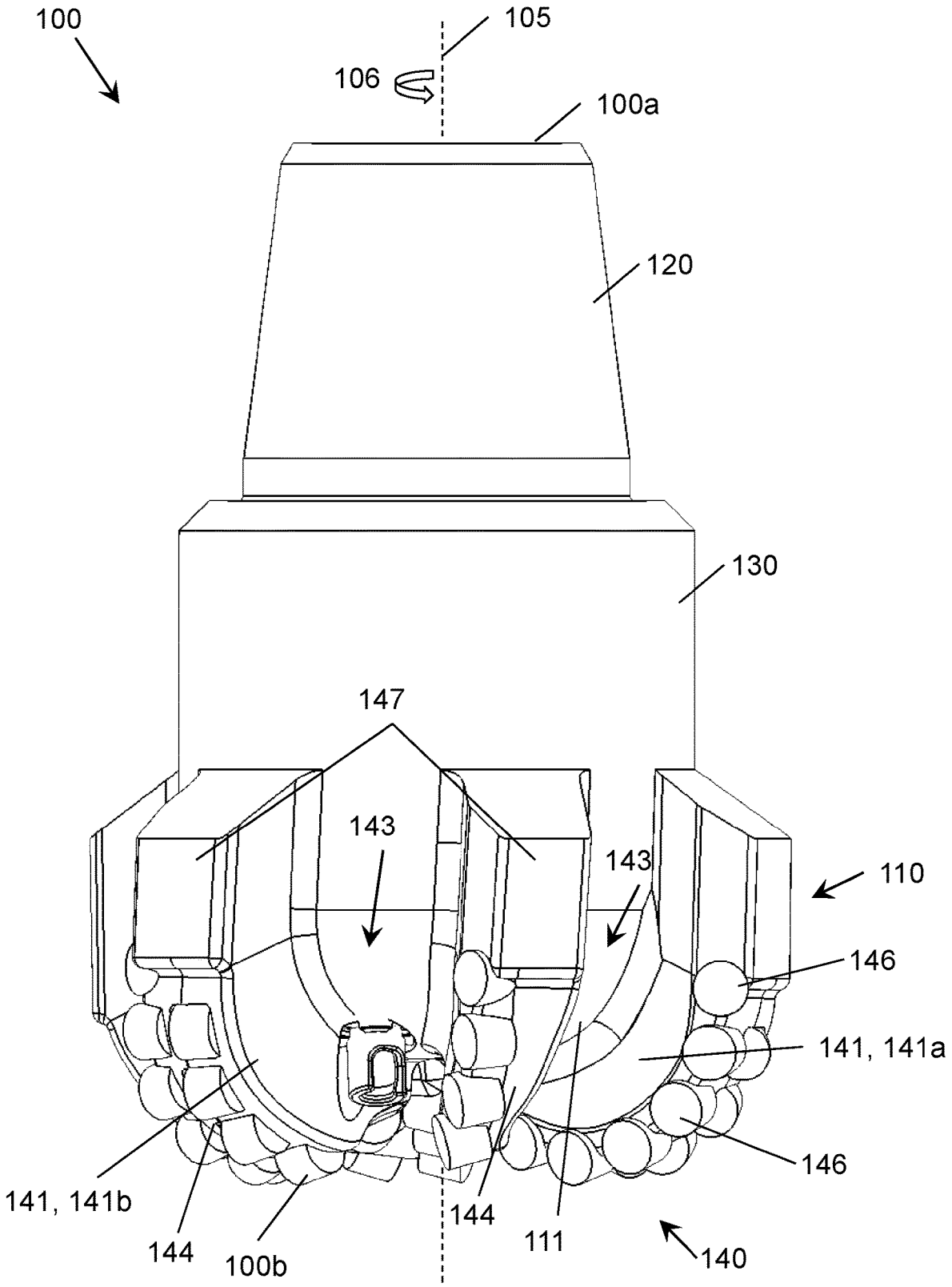
FIG. 3 is a side view of the drill bit of FIG. 2.
Figure 4:
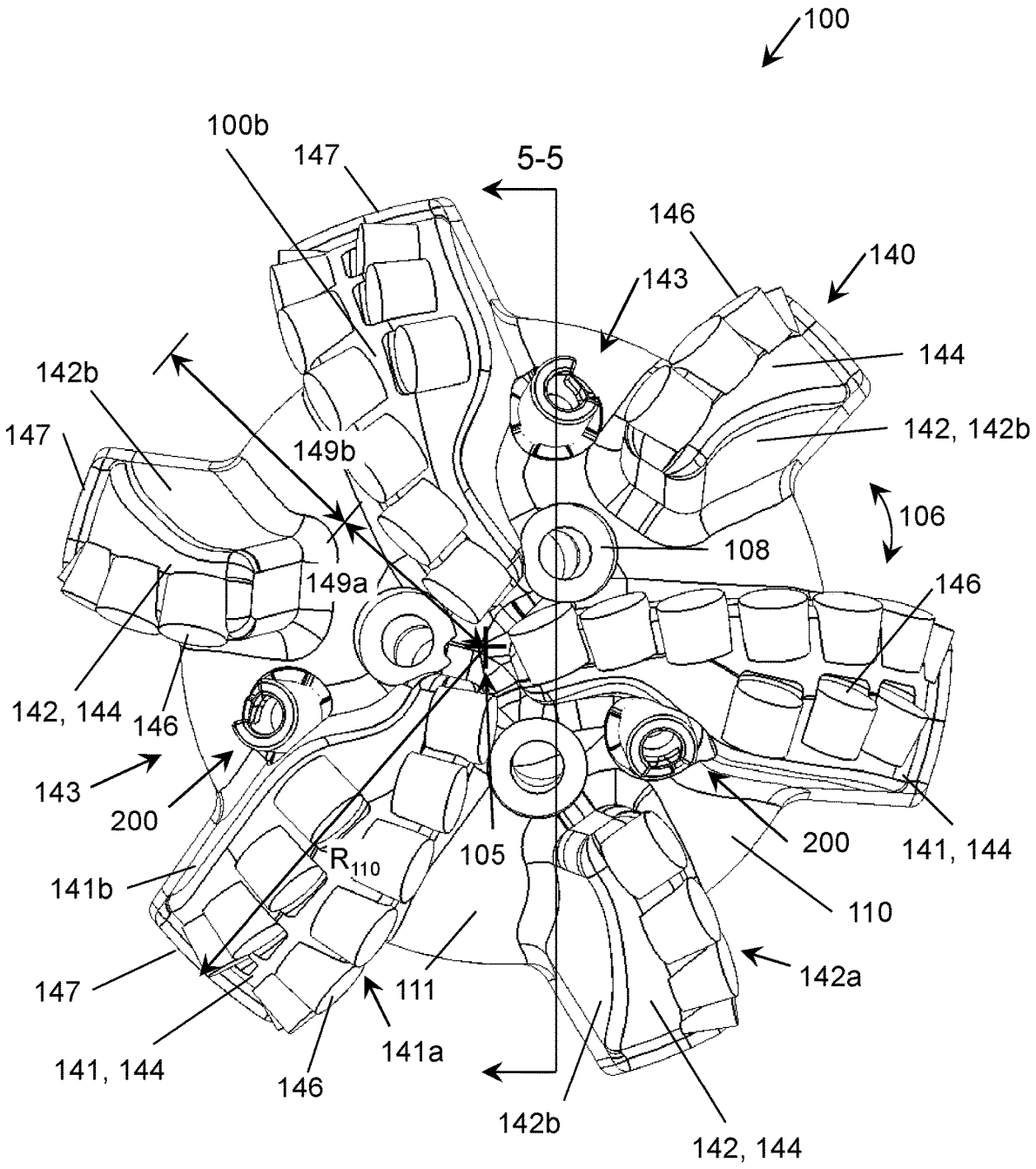
FIG. 4 is an end view of the drill bit of FIG. 2.

Referring now to FIGS. 2-4, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to a drill string (not shown), which is employed to rotate the bit in order to drill the borehole. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades which extend from bit face 111. As best shown in FIGS. 2 and 4, in this embodiment, cutting structure 140 includes three angularly spaced-apart primary blades 141, and three angularly spaced apart secondary blades 142. Further, in this embodiment, the plurality of blades (e.g., primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

In this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2-4, each blade 141, 142 includes a cutter-supporting surface 144 for mounting a plurality of cutter elements 145. In particular, cutter elements 145 are arranged adjacent one another in a radially extending row proximal the leading edge of each primary blade 141 and each secondary blade 142. In this embodiment, each primary blade 141 also includes a plurality of cutter elements 145 are arranged adjacent one another in a radially extending second row that trails the first row on the same primary blade 142 relative to the direction of bit rotation 106.

Each cutter element 145 has a cutting face 146 and comprises an elongated and generally cylindrical support member or substrate which is received and secured in a pocket formed in the surface of the blade to which it is fixed. In general, each cutter element may have any suitable size and geometry. In this embodiment, each cutter element 145 has substantially the same size and geometry. Cutting face 146 of each cutter element 145 comprises a disk or tablet-shaped, hard cutting layer of polycrystalline diamond or other superabrasive material is bonded to the exposed end of the support member. In the embodiments described herein, each cutter element 145 is mounted such that its cutting face 146 is generally forward-facing. As used herein, "forward-facing" is used to describe the orientation of a surface that is substantially perpendicular to, or at an acute angle relative to, the cutting direction of the bit (e.g., cutting direction 106 of bit 100). For instance, a forward-facing cutting face (e.g., cutting face 146) may be oriented perpendicular to the direction of rotation 106 of bit 100, may include a backrake angle, and/or may include a siderake angle. However, the cutting faces are preferably oriented perpendicular to the direction of rotation 106 of bit 100 plus or minus a 45° backrake angle and plus or minus a 45° siderake angle. In addition, each cutting face 146 includes a cutting edge adapted to positively engage, penetrate, and remove formation material with a shearing action, as opposed to the grinding action utilized by impregnated bits to remove formation material. Such cutting edge may be chamfered or beveled as desired. In this embodiment, cutting faces 146 are substantially planar, but may be convex or concave in other embodiments.

Referring still to FIGS. 2-4, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 145 wear slightly under gage. Gage pads 147 also help stabilize bit 100 against vibration.

Figure 6:
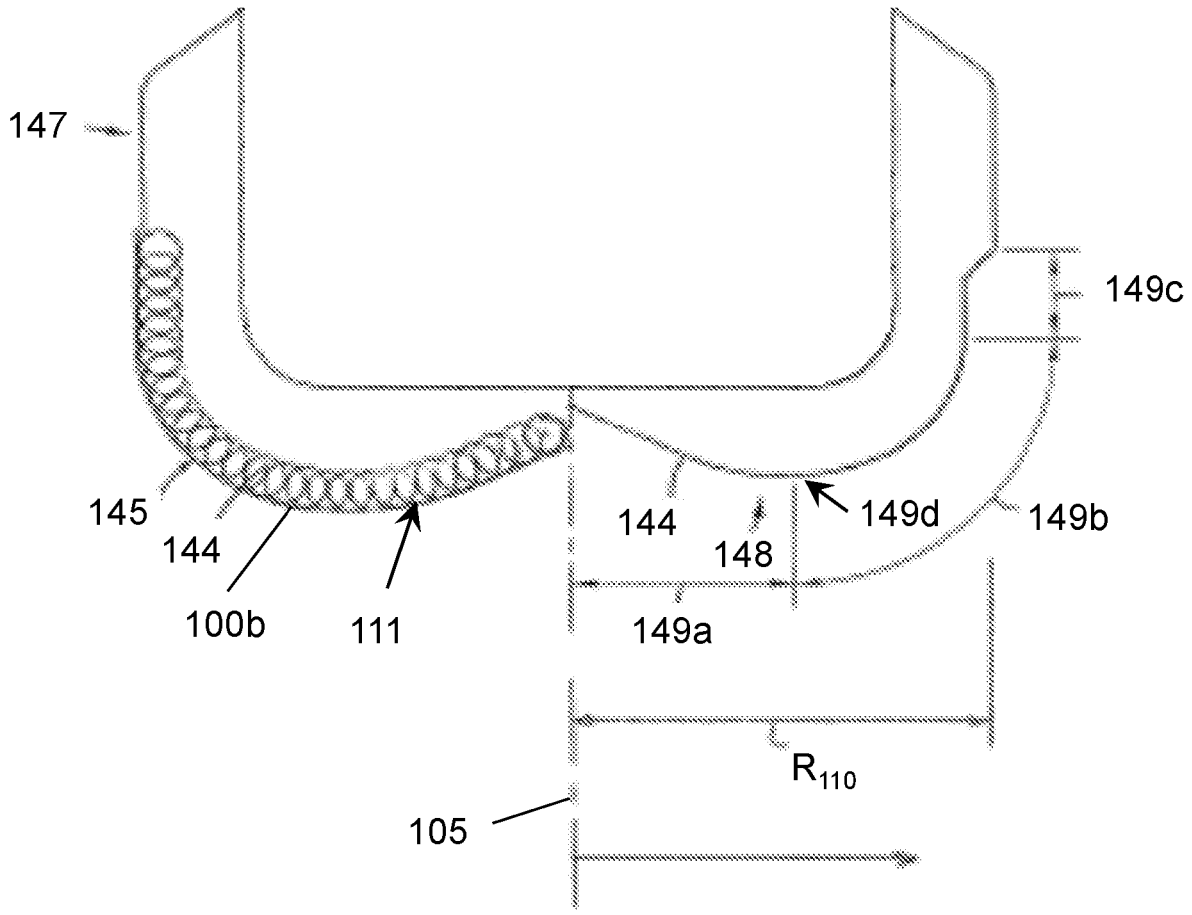
FIG. 6 is a partial cross-sectional schematic view of the bit shown in FIG. 2 with the blades and the cutting faces of the cutter elements rotated into a single composite profile.

Referring now to FIG. 6, an exemplary profile of bit body 110 is shown as it would appear with blades 141, 142 and cutter elements 145 rotated into a single rotated profile. In rotated profile view, blades 141, 142 of bit body 110 form a combined or composite blade profile 148 generally defined by cutter-supporting surfaces 144 of blades 141, 142. Composite blade profile 148 and bit face 111 may generally be divided into three regions conventionally labeled cone region 149*a*, shoulder region 149*b*, and gage region 149*c*. Cone region 149*a* comprises the radially innermost region of bit body 110 and composite blade profile 148 extending from bit axis 105 to shoulder region 149*b*. In this embodiment, cone region 149*a* is generally concave. Adjacent cone region 149*a* is generally convex shoulder region 149*b*. The transition between cone region 149*a* and shoulder region 149*b*, typically referred to as the nose 149*d*, occurs at the axially outermost portion of composite blade profile 148 where a tangent line to the blade profile 148 has a slope of zero. Moving radially outward, adjacent shoulder region 149*b* is the gage region 149*c* which extends substantially parallel to bit axis 105 at the outer radial periphery of composite blade profile 148. As shown in composite blade profile 148, gage pads 147 define the gage region 149*c* and the outer radius $R_{110}$ of bit body 110. Outer radius $R_{110}$ extends to and therefore defines the full gage diameter of bit body 110.

Referring briefly to FIG. 4, moving radially outward from bit axis 105, bit face 111 includes cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In this embodiment, secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (e.g., primary blades 141, secondary blades, 142, etc.), and cutter elements (e.g., cutter elements 145) are possible.

Figure 5:
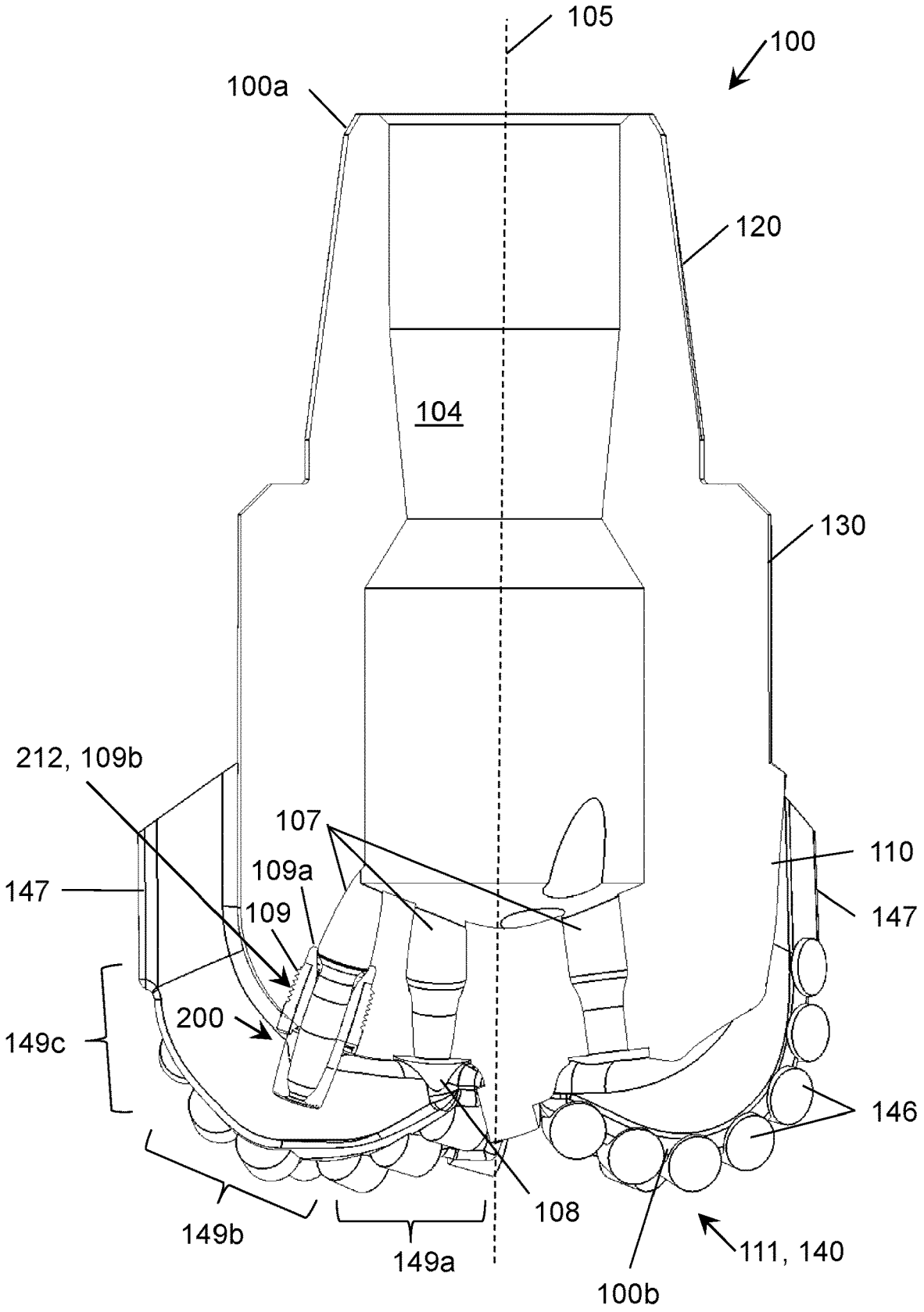
FIG. 5 is a cross-sectional view of the drill bit of FIG. 2 taken in reference plane 5-5 of FIG. 4.

Referring now to FIG. 5, bit 100 includes an internal plenum 104 extending axially from uphole end 100*a* through pin 120 and shank 130 into bit body 110. Plenum 104 permits drilling fluid to flow from the drill string into bit 100. Body 110 is also provided with a plurality of flow passages 107 extending from plenum 104 to downhole end 100*b*. As best shown in FIGS. 4 and 5, a plurality of circumferentially-spaced radially inner nozzles 108 and a plurality of circumferentially-spaced radially outer nozzle assemblies 200 are seated in the lower ends of flow passages 107; one nozzle 108 or nozzle assembly 200 is disposed at the downhole end of each flow passage 107. Together, passages 107, nozzles 108, and nozzle assemblies 200 serve to distribute drilling fluid around cutting structure 140 to flush away formation cuttings and to remove heat from cutting structure 140, and more particularly cutting elements 145, during drilling.

As previously described, bit 100 includes a plurality of circumferentially-spaced inner nozzles 108 and a plurality of circumferentially-spaced outer nozzle assemblies 200. In general, nozzles 108 and nozzle assemblies 200 can be positioned at any suitable location and at any suitable orientation. As best shown in FIGS. 4 and 5, in this embodiment, nozzles 108 are positioned proximal bit axis 105 radially inside nozzle assemblies 200. In particular, each nozzle 108 is positioned in a flow course 143 within the cone region 149*a*, circumferentially positioned between a circumferentially-adjacent pair of primary blades 141, and radially positioned between the radially inner end of the corresponding secondary blade 142 and bit axis 105. Whereas each nozzle assembly 200 is positioned in a flow course 143 within the shoulder region 149*b* (proximal the nose 149*d*), circumferentially positioned between one secondary blade 142 and a circumferentially adjacent primary blade 141 that leads the secondary blade 142, and positioned at about the same radial position as the radially inner end of the corresponding secondary blade 142. In addition, in this embodiment, nozzle assemblies 200 are positioned and oriented to direct drilling fluid toward the cutter elements 145 in the shoulder region 149*b* disposed along the leading sides 142*a* of the immediately trailing secondary blades 142. In other embodiments, the nozzle assemblies 200 can be positioned and oriented to direct drilling fluid toward other cutter elements 145 such as, for example, cutter elements 145 in the shoulder region 149*b* disposed along the leading sides 141*a* of the primary blades 141. However, embodiments of nozzle assemblies 200 offer the potential to advantageously enhance the distribution of drilling fluid therefrom and the shear stress applied to the cutting faces 146 of cutter elements 145 as compared to most conventional nozzles. Since the cutter elements disposed along the shoulder region (e.g., cutter elements 145 disposed along shoulder region 149*b*) typically experience the most thermal stress (as compared to cutter elements disposed along the cone and gage regions), nozzle assemblies 200 may provide particularly beneficial results if positioned and oriented to direct drilling fluid toward such cutter elements disposed along the shoulder region of the bit.

Referring now to FIGS. 7-11, one nozzle assembly 200 is shown. In this embodiment, each nozzle assembly 200 is the same, and thus, only one nozzle assembly 200 will be described, it being understood the other nozzle assemblies 200 are identical. Nozzle assembly 200 has a central axis 205, a first or uphole end 200*a*, and a second or downhole end 200*b* opposite end 200*a*. In addition, nozzle assembly 200 includes an outer sleeve 210 and an inner nozzle 230 disposed within and extending through sleeve 210. Sleeve 210 and nozzle 230 are coaxially aligned, each having a central or longitudinal axis coincident with axis 205.

Figure 10:
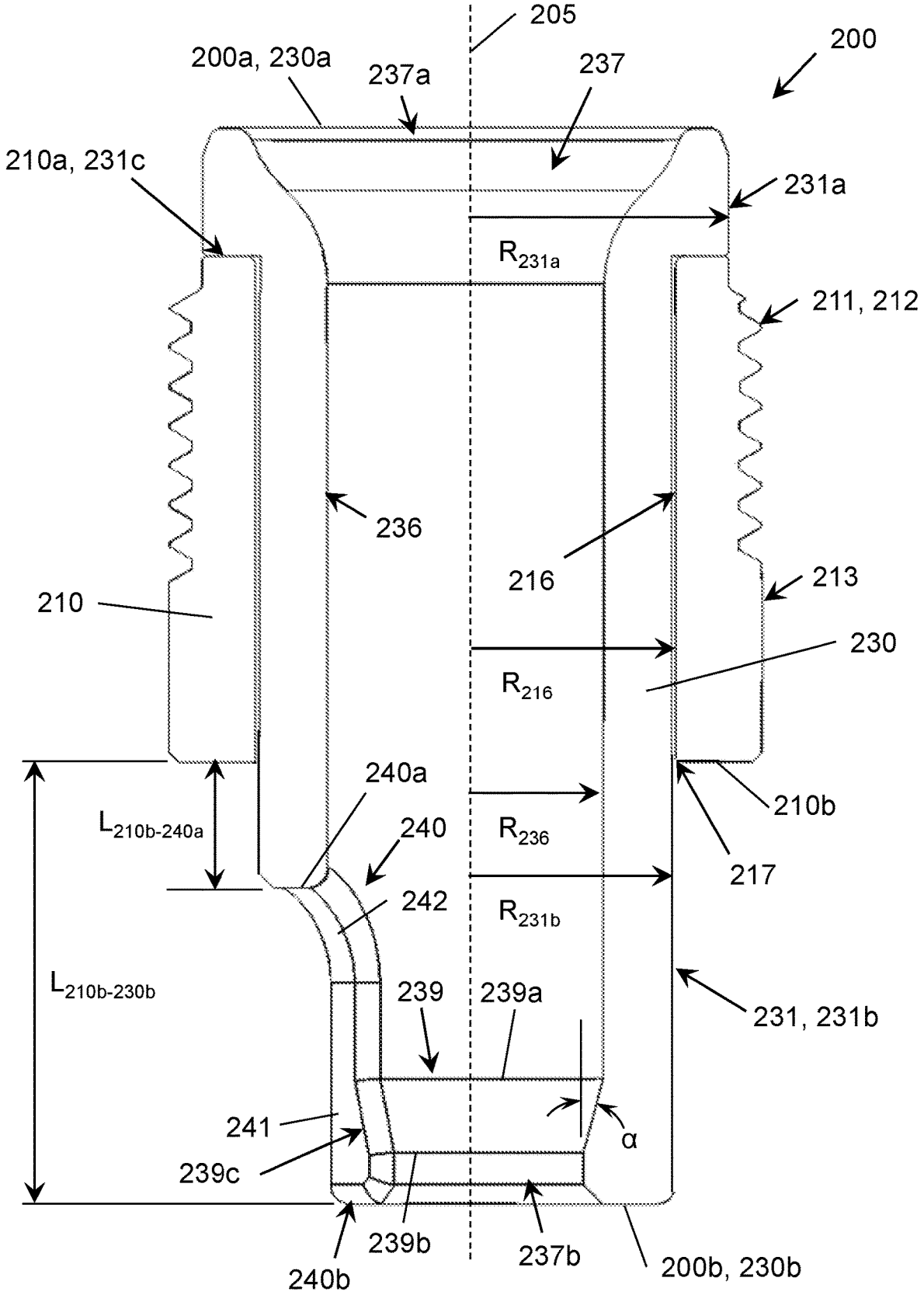
FIG. 10 is a cross-sectional view of the drilling fluid nozzle assembly of FIG. 7 taken in reference plane 10-10 of FIG. 9.

Outer sleeve 210 has a first or uphole end 210*a* proximal end 200*a*, a second or downhole end 210*b* distal end 200*a*, a radially outer surface 211 extending axially between ends 210*a*, 210*b*, and a radially inner surface 216 extending axially between ends 210*a*, 210*b*. In this embodiment, each end 210*a*, 210*b* comprises an annular planar surface disposed in a plane oriented perpendicular to axis 205. Outer surface 211 includes external threads 212 extending axially from first end 210*a* and a cylindrical surface 213 extending axially from threads 212 to second end 210*b*. As will be described in more detail below, threads 212 removably secure nozzle assembly 200 to bit body 110. As best shown in FIG. 10, inner surface 216 is a cylindrical surface disposed at an inner radius $R_{216}$ measured radially from axis 205. In addition, inner surface 216 defines a passage or throughbore 217 extending axially through sleeve 210 from first end 210*a* to second end 210*b*. Nozzle 230 extends through passage 217.

Figure 11:
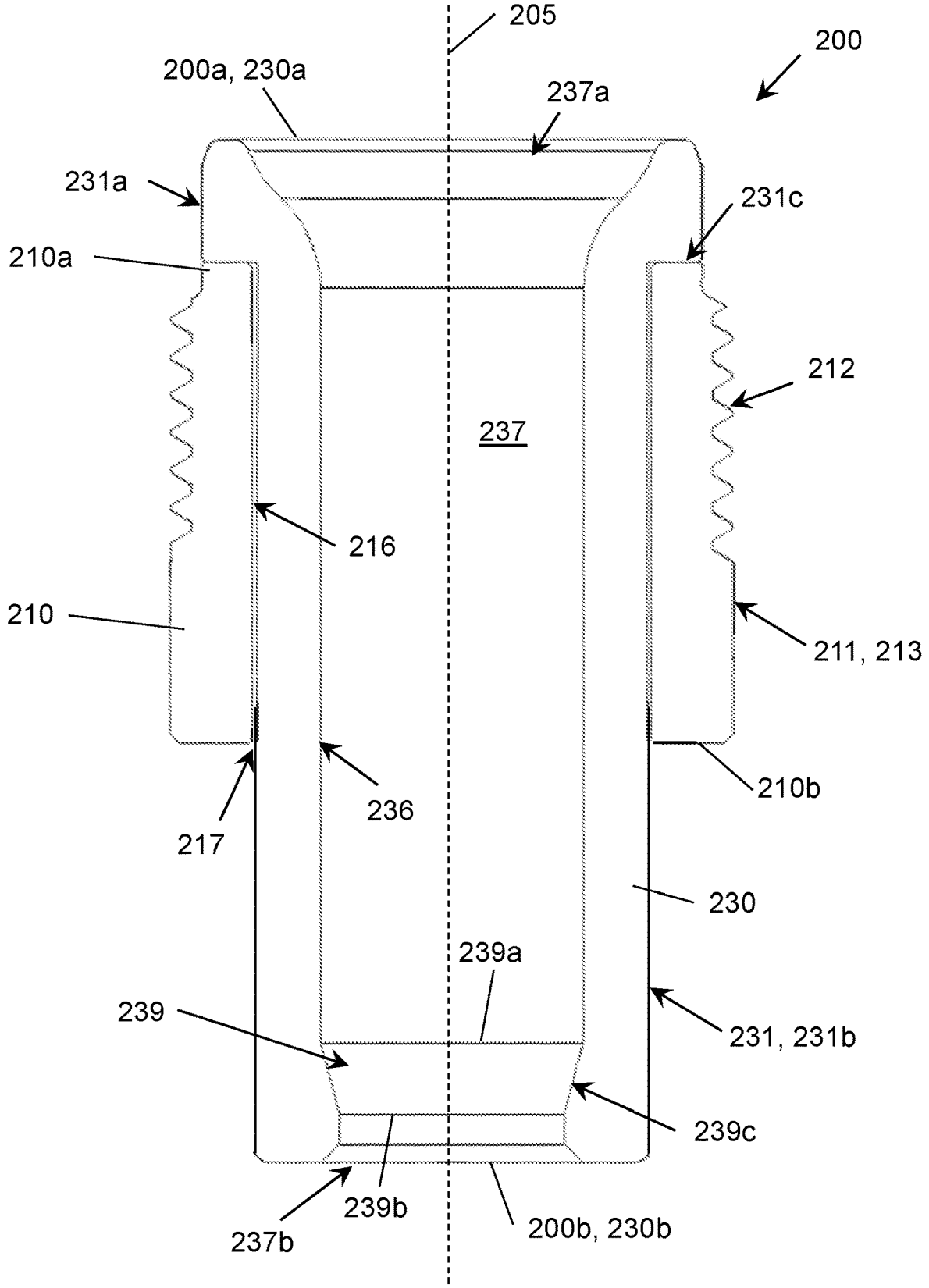
FIG. 11 is a cross-sectional view of the drilling fluid nozzle assembly of FIG. 7 taken in reference plane 11-11 of FIG. 9.

Referring still to FIGS. 7-11, nozzle 230 has a first or uphole end 230*a* coincident with and defining end 200*a* of assembly 200, a second or downhole end 230*b* coincident with and defining end 200*b* of assembly 200, a radially outer surface 231 extending axially between ends 230*a*, 230*b*, and a radially inner surface 236 extending axially between ends 230*a*, 230*b*. In this embodiment, each end 230*a*, 230*b* comprises an annular planar surface disposed in a plane oriented perpendicular to axis 205. As best shown in FIGS. 10 and 11, outer surface 231 includes a cylindrical surface 231*a* extending axially from first end 230*a*, a cylindrical surface 231*b* extending axially from second end 230*b*, and an annular planar shoulder 231*c* extending radially between cylindrical surfaces 231*a*, 231*b*. In this embodiment, an annular bevel or chamfer is provided between cylindrical surface 231*a* and first end 230*a*, and an annular bevel or chamfer is provided between cylindrical surface 231*b* and second end 230*b*. Cylindrical surface 231*a* is disposed at an outer radius $R_{231a}$ measured radially from axis 205, and cylindrical surface 231*b* is disposed at an outer radius $R_{231b}$ measured radially from axis 205. Radius $R_{231a}$ is greater than radius $R_{231b}$, and thus, shoulder 231*c* extends radially inward from surface 231*a* to surface 231*b*.

Referring specifically to FIGS. 10 and 11, inner surface 236 defines a throughbore or passage 237 extending axially through nozzle 230 from first end 230*a* to second end 230*b*. During drilling operations, drilling fluid enters passage 237 at end 230*a* and exits nozzle 230 at end 230*b*. Accordingly, passage 237 includes or defines a drilling fluid inlet 237*a* at first end 230*a* and a drilling fluid outlet 237*b* at second end 230*b*.

A choke 239 is provided along passage 237. Choke 239 has a first or uphole end 239*a* and a second or downhole end 239*b*. In this embodiment, choke 239 is axially positioned (relative to axis 205) at or proximal outlet 237*b* and second end 230*b*. However, as will be described in more detail below, in other embodiments, the axial position of the choke (e.g., choke 239) along the nozzle passage (e.g., passage 237) can vary.

As best shown in FIG. 10, in this embodiment, choke 239 is formed or defined by inner surface 236. In particular, inner surface 236 is disposed at an inner radius $R_{236}$ measured radially from axis 205. Moving axially from first end 230*a* to second end 230*b* of nozzle 230, radius $R_{236}$ decreases along inlet 237*a*, is constant between inlet 237*a* and choke 239 (i.e., inner surface 236 is a cylindrical surface between inlet 237*a* and choke 239), and decreases along choke 239 (i.e., decreases between uphole end 239*a* and downhole end 239*b*). Consequently, in this embodiment, the cross-sectional area of passage 237 taken in a plane oriented perpendicular to axis 205 generally decreases moving axially along inlet 237*a*, is constant between inlet 237*a* and choke 239, and decreases along choke 239. Thus, the radius $R_{237}$ and cross-sectional area of passage 237 taken in a plane oriented perpendicular to axis 205 is a minimum at the downstream end 239*b* of choke 239. The decreasing radius $R_{236}$ and cross-sectional area at inlet 237*a* accelerates drilling fluid as it enters nozzle 230, and the decreasing radius $R_{236}$ and cross-sectional area at choke 239 chokes the flow of drilling fluid. In this embodiment, inner surface 236 includes a frustoconical surface 239*c* proximal end 230*b* that defines choke 239. Surface 239*a* is disposed at an acute angle $\alpha$ measured downward from axis 205. In embodiments described herein, angle α is preferably between 0° and 30°, and more preferably between 0° and 20°. In this embodiment, angle α is 15°.

Referring still to FIGS. 10 and 11, sleeve 210 is disposed about nozzle 230 with end 210*a* of sleeve 210 axially abutting shoulder 231*c* of nozzle 230 and cylindrical inner surface 216 of sleeve 210 slidingly engaging mating cylindrical surface 231*b* of nozzle 230. Thus, inner radius $R_{216}$ is substantially the same or slightly greater than outer radius $R_{231b}$. In addition, with end 210*a* engaging shoulder 231*c*, nozzle 230 extends axially (relative to axis 205) from sleeve 210. More specifically, nozzle 230 extends from sleeve 210 a length $L_{210b\text{-}230b}$ measured axially (relative to axis 205) from end 210*b* to end 230*b*. In general, the length $L_{210b\text{-}230b}$ can vary from bit to bit depending on a variety of factors, however, for most applications, the length $L_{210b\text{-}230b}$ is preferably between 0.2 in. and 2.0 in., and more preferably between 0.5 in. and 1.0 in.

Figure 7:
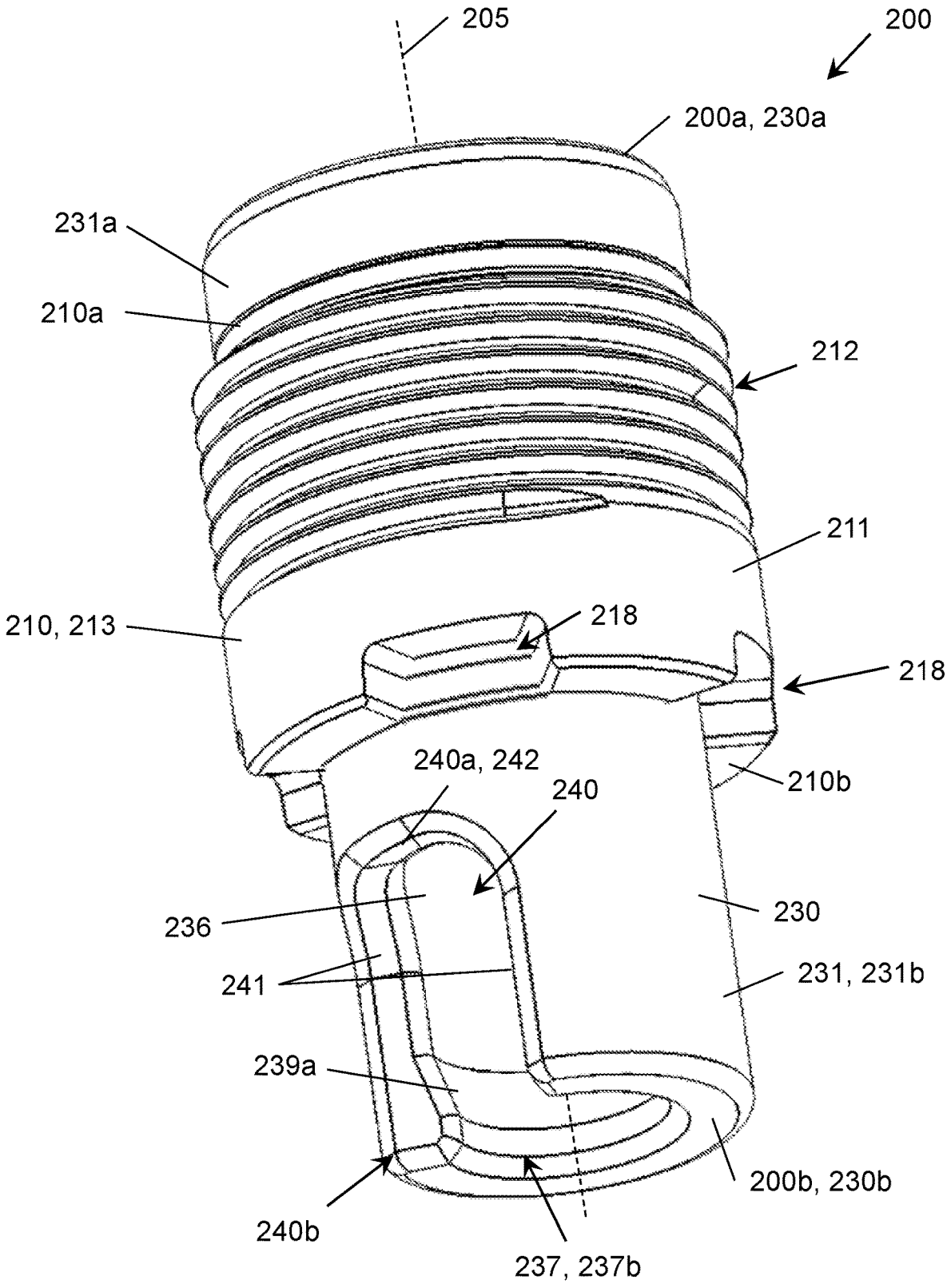
FIG. 7 is a perspective view of one of the drilling fluid nozzle assemblies of FIG. 2.
Figure 8:
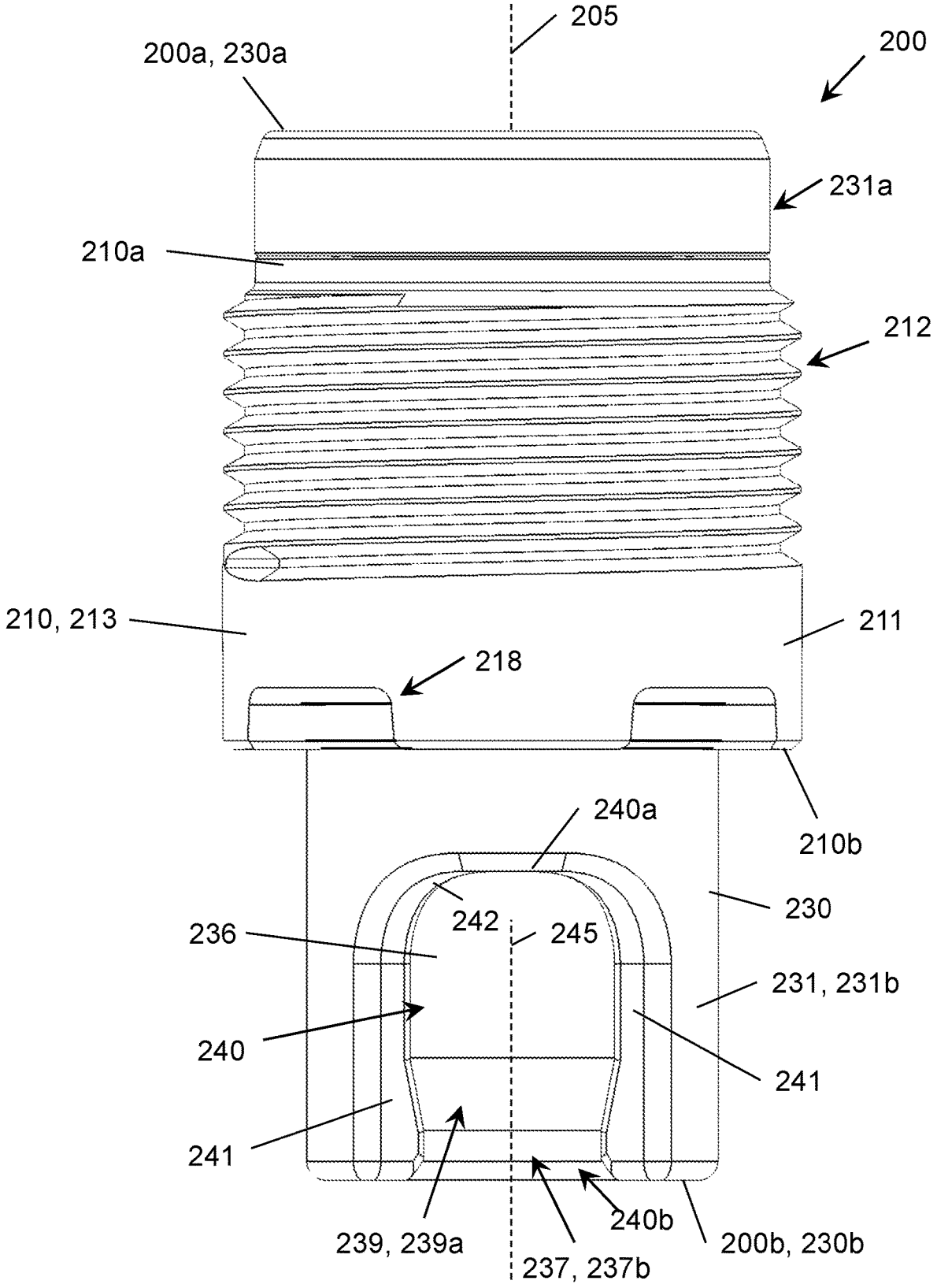
FIG. 8 is a side view of the drilling fluid nozzle assembly of FIG. 7.

Referring again to FIGS. 7-10, in embodiments described herein, nozzle 230 also includes a side outlet or port 240 extending axially from end 230*b* and extending radially through nozzle 230 from inner surface 236 to outer surface 231. Side port 240 is contiguous with and extends axially from outlet 237*b* at end 230*b*. Thus, side port 240 is in fluid communication with passage 237 and outlet 237*b*. As best shown in FIG. 8, side port 240 has a central or longitudinal axis 245 in side view, a first or uphole end 240*a*, and a second or downhole end 240*b* at end 230*b*. In this embodiment, uphole end 240*a* is axially positioned between end 210*b* of sleeve 210 and end 230*b* of nozzle 230, and more particularly, uphole end 240*a* is axially positioned between second end 210*b* of sleeve 210 and choke 239. In other words, side port 240 extends axially from end 230*b* beyond choke 239, but does not extend to sleeve 210. In particular, as best shown in FIG. 10, uphole end 240*a* of side port 240 is spaced an axial length $L_{210b\text{-}240a}$ measured axially (relative to axes 205, 245) in side view from downhole end 210*b* of sleeve 210 to uphold end 240*a* of side port 240. In general, the length $L_{210b\text{-}240a}$ can vary from bit to bit depending on a variety of factors, however, for most applications, the length $L_{210b\text{-}240a}$ is preferably at least 0.1 in., and more preferably at least 0.3 in. Drilling fluid flowing through passage 237 exits nozzle 230 simultaneously through outlet 237*b* and side port 240. Side port 240 is preferably spaced from sleeve 210 by length $L_{210b\text{-}240a}$ to reduce and/or eliminate erosion of sleeve 210 and bit body 110 by the drilling fluid exiting side port 240.

Figure 9:
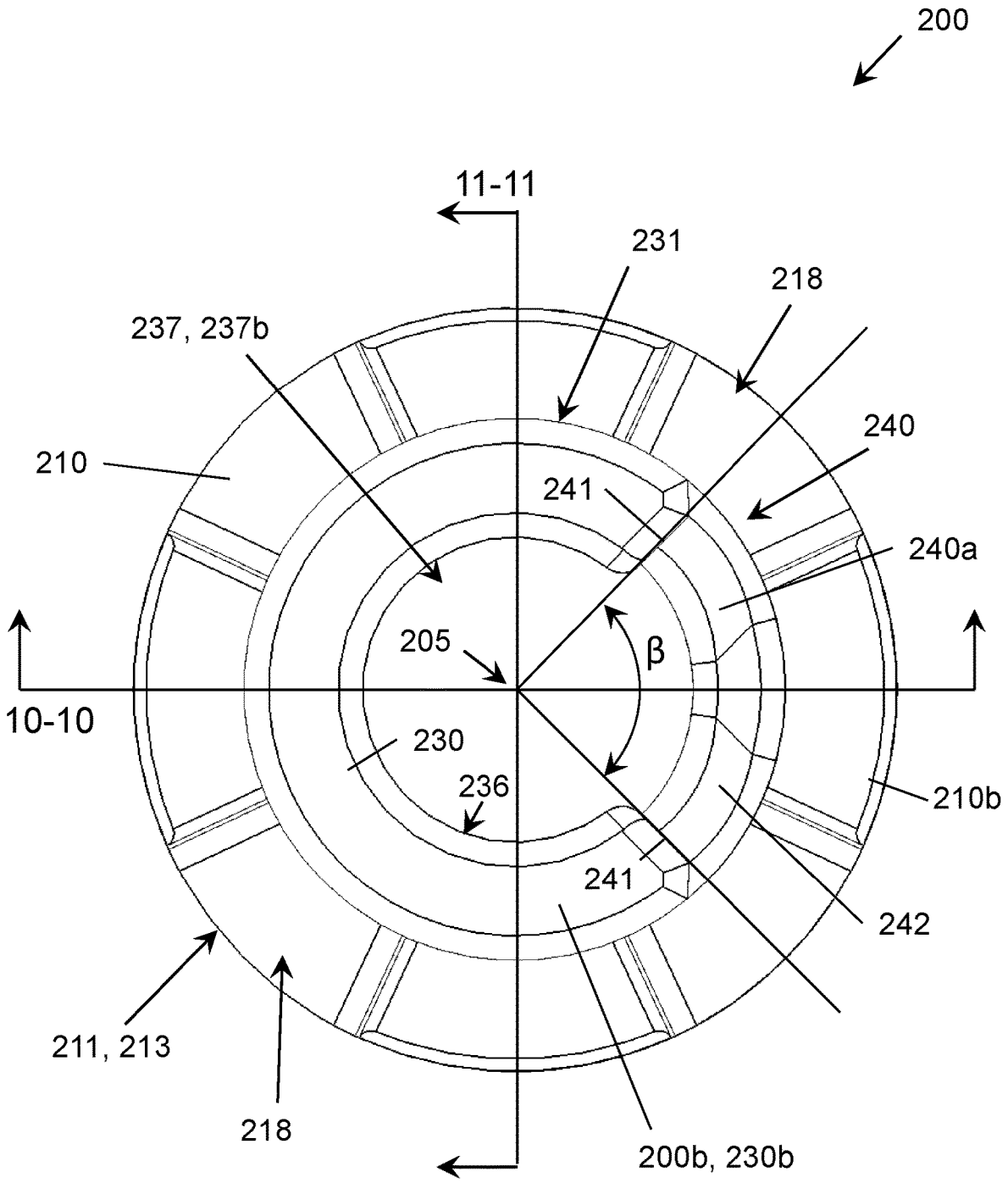
FIG. 9 is an end view of the of the drilling fluid nozzle assembly of FIG. 7.

Choke 239 directs and facilitates the flow of at least some of the drilling fluid in passage 237 radially outward through side port 240. In particular, in embodiments described herein, the axial position of choke 239 along passage 237 preferably at least partially overlaps with side port 240 such that the restriction of drilling fluid flow induced by choke 239 forces a portion of drilling fluid flowing through passage 237 to flow radially outward and exit through side port 240. In other words, side outlet 240 intersects and extends axially across at least a portion of the choke 239 such that at least a portion of choke 239 is positioned along side outlet 240. In this embodiment, the entire choke 239 is axially positioned between ends 240*a*, 240*b* of side outlet 240 (i.e., both ends 239*a*, 239*b* are axially positioned between ends 240*a*, 240*b*). However, in other embodiments, only one end of the choke is axially positioned between the ends of the side outlet. For example, in one embodiment, uphole end 239*a* of choke 239 is axially spaced from side outlet 240 (e.g., above both ends 240*a*, 240*b* of side outlet 240) and downhole end 239*b* of choke is axially positioned along side outlet 240 (i.e., between ends 240*a*, 240*b* of side outlet 240). Referring now to FIGS. 7 and 8, in this embodiment, side port 240 is generally U-shaped. In particular, side port 240 is defined by a pair of circumferentially-spaced parallel side edges or walls 241 and a smoothly curved concave end edge or wall 242 extending between walls 241. Side walls 241 extend radially through nozzle 230 from outer surface 231 to inner surface 236, and extend axially from ends 230*b*, 240*b*. End wall 242 extend radially through nozzle 230 from outer surface 231 to inner surface 236 and defines uphole end 240*a*. Although side port 240 has a U-shaped geometry with parallel side walls 241 in this embodiment, in other embodiments, the side port (e.g., side port 240) can have other geometries such as V-shaped, U-shaped with non-parallel side walls, etc. As best shown in FIG. 9, side port 240 extends circumferentially through an angle β measured about axis 205 between side walls 241 at downhole ends 230*b*, 240*b*. In embodiments described herein, angle β is preferably less than or equal to 180°, and more preferably about 90°. In this embodiment, angle β is 90°.

Figure 12:
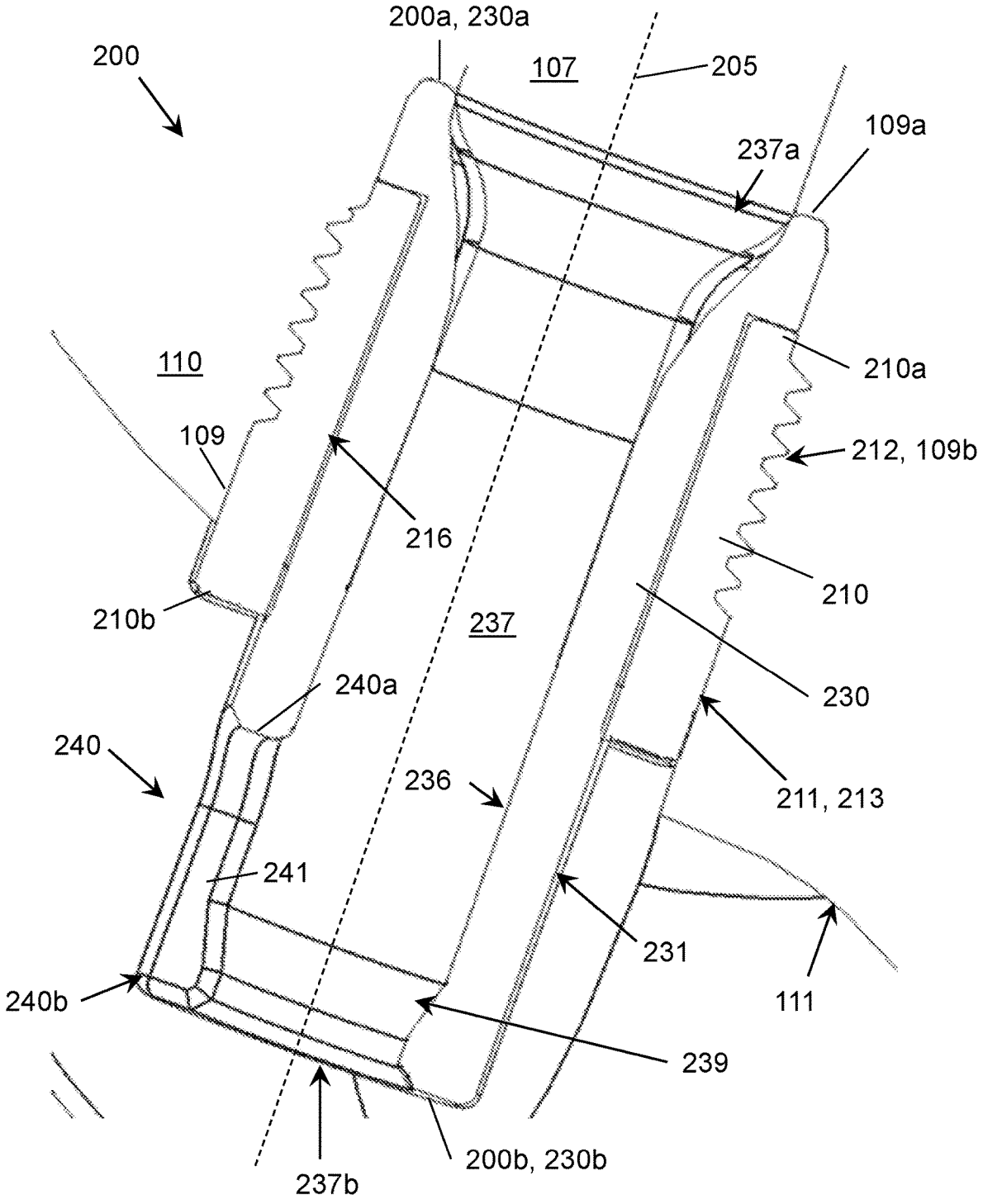
FIG. 12 is a partial cross-sectional view of the drill bit of FIG. 2 illustrating one nozzle assembly seated in the bit body and extending from the bit face.

As best shown in FIGS. 5 and 12, a counterbore or receptacle 109 is provided in bit face 111 at the downhole end of each flow passage 107. Each receptacle 109 includes an annular planar shoulder 109*a* and internal threads 109*b*. Shoulder 109*a* is disposed at the intersection of the receptacle 109 and corresponding passage 107. Receptacles 109 are sized to mate with nozzle assemblies 200. In particular, each nozzle assembly 200 is secured to bit body 110 by positioning nozzle 230 within sleeve 210, urging sleeve 210 against shoulder 231*c*, and inserting ends 210*a*, 230*a* into receptacle 109. Next, sleeve 210 is threaded into receptacle 109 via engagement of mating threads 212, 109*b* until uphole ends 200*a*, 230*a* axially abuts and is seated against shoulder 109*a*. Sleeve 210 may be tightened to squeeze nozzle 230 against shoulder 109*a*. In this embodiment, a plurality of circumferentially-spaced notches 218 are provided at end 210*b* for positively engaging sleeve 210 with a tool for threading sleeve 210 into receptacle 109. Although sleeve 210 is threadably coupled to bit body 110 in this embodiment, in other embodiments, the sleeve (e.g., sleeve 210) can be coupled to the bit body (e.g., bit body 110) by other suitable means such as welding, a snap ring, etc.

As previously described, during drilling operations, drilling fluid flows through passages 107 to nozzle assemblies 200, and then into nozzle 230 via inlet 237*a*, through passage 237, and out of nozzle 230 via outlets 237*b*, 240. The restriction fluid flow through nozzle 230 at outlet 237 caused by choke 239 forces a portion of drilling fluid through side outlet 240. Since side outlet 240 and outlet 237*b* are contiguous, the geometry of the drilling fluid exiting nozzle 230 is generally fan-shaped as opposed to cylindrical as is typical of most conventional nozzle. Accordingly, drilling fluid exiting nozzle 230 can cover a greater surface area of bit 100 as compared to a similarly sized and positioned conventional nozzle. In addition, drilling fluid exiting outlet 237*b* can be directed to the bottom of the borehole while drilling fluid exiting side outlet 240 can be directed to specific cutter elements 245. In this embodiment, nozzle assemblies 200 are positioned and oriented in bit body 210 to direct drilling fluid exiting side outlets 240 toward cutter elements 245 disposed along shoulder region 149*b*, which typically experience the greatest thermal stresses.

Figure 13:
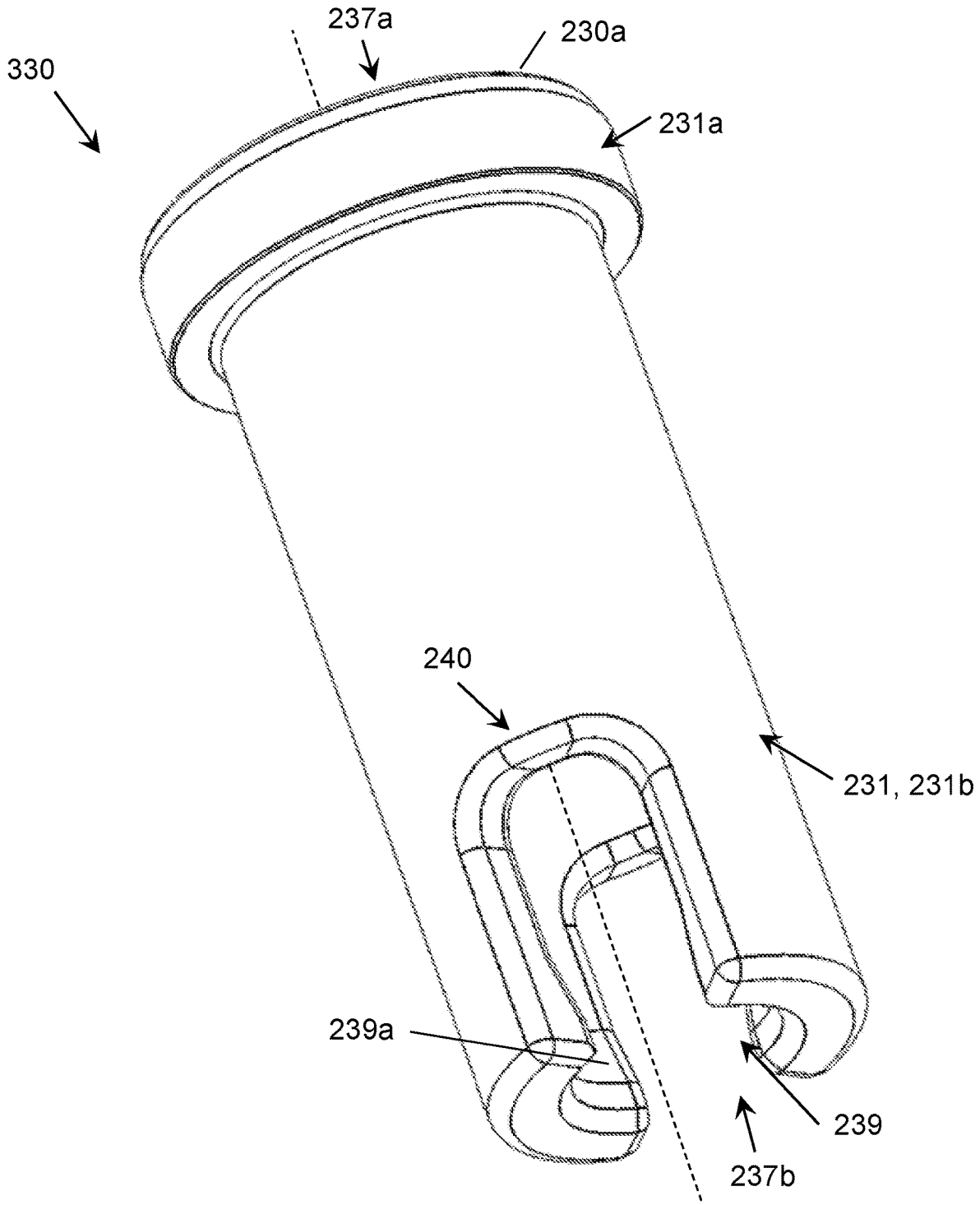
FIG. 13 is perspective view of an embodiment of a nozzle in accordance with the principles described herein.

In the embodiment of nozzle assembly 200 described above and shown in FIGS. 7-11, one side outlet 240 is provided in nozzle 230. However, in other embodiments, more than one side outlet or port is provided. For example, referring now to FIGS. 13-15, another embodiment of a nozzle 330 that can be used in the place of nozzle 230 previously described is shown. Nozzle 330 is substantially the same as nozzle 230 previously described with the exception that nozzle 330 includes a plurality of side outlets or ports 240. Each port 240 is as previously described with respect to nozzle 230.

Figure 14:
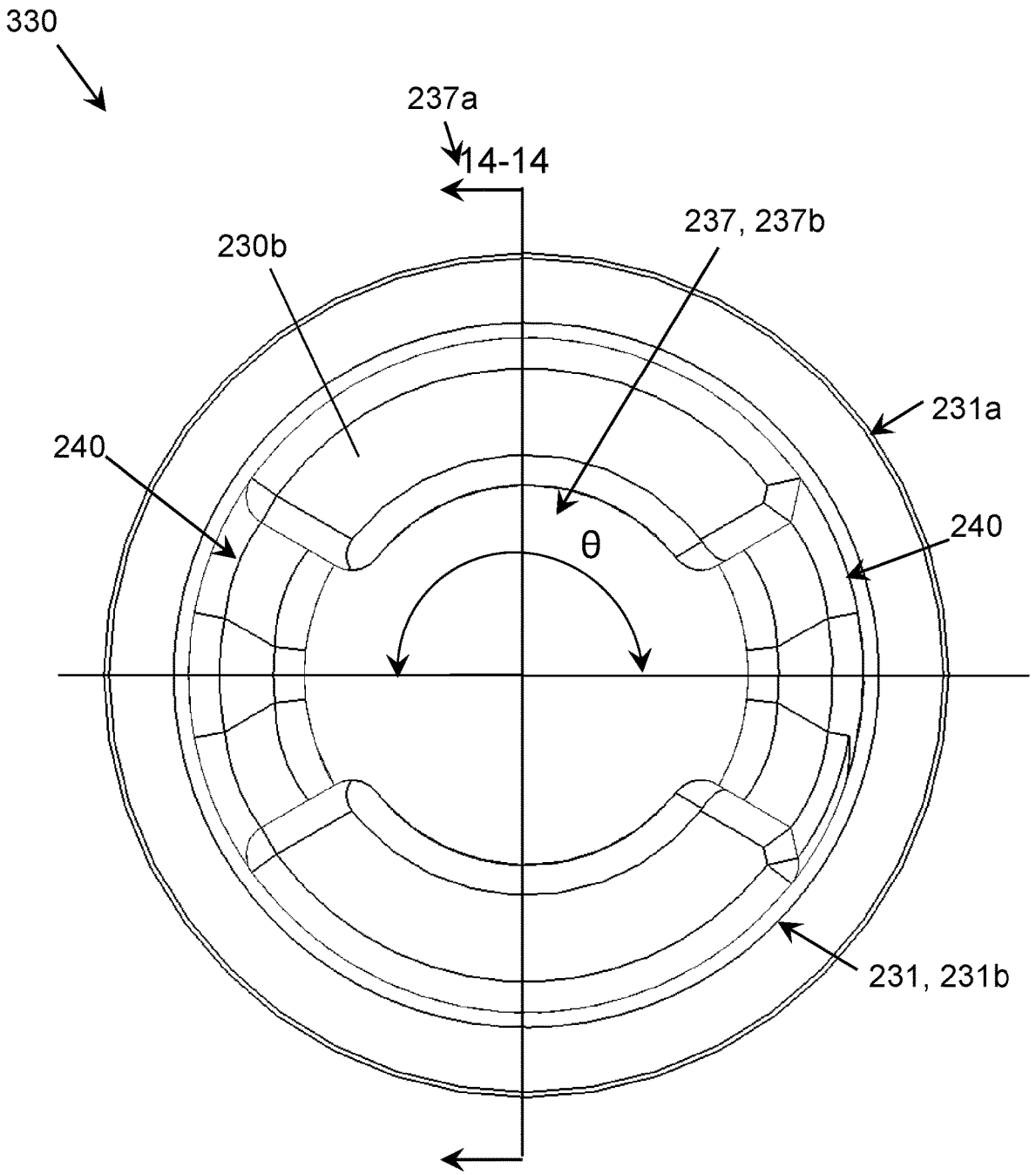
FIG. 14 is an end view of the nozzle of FIG. 13.
Figure 15:
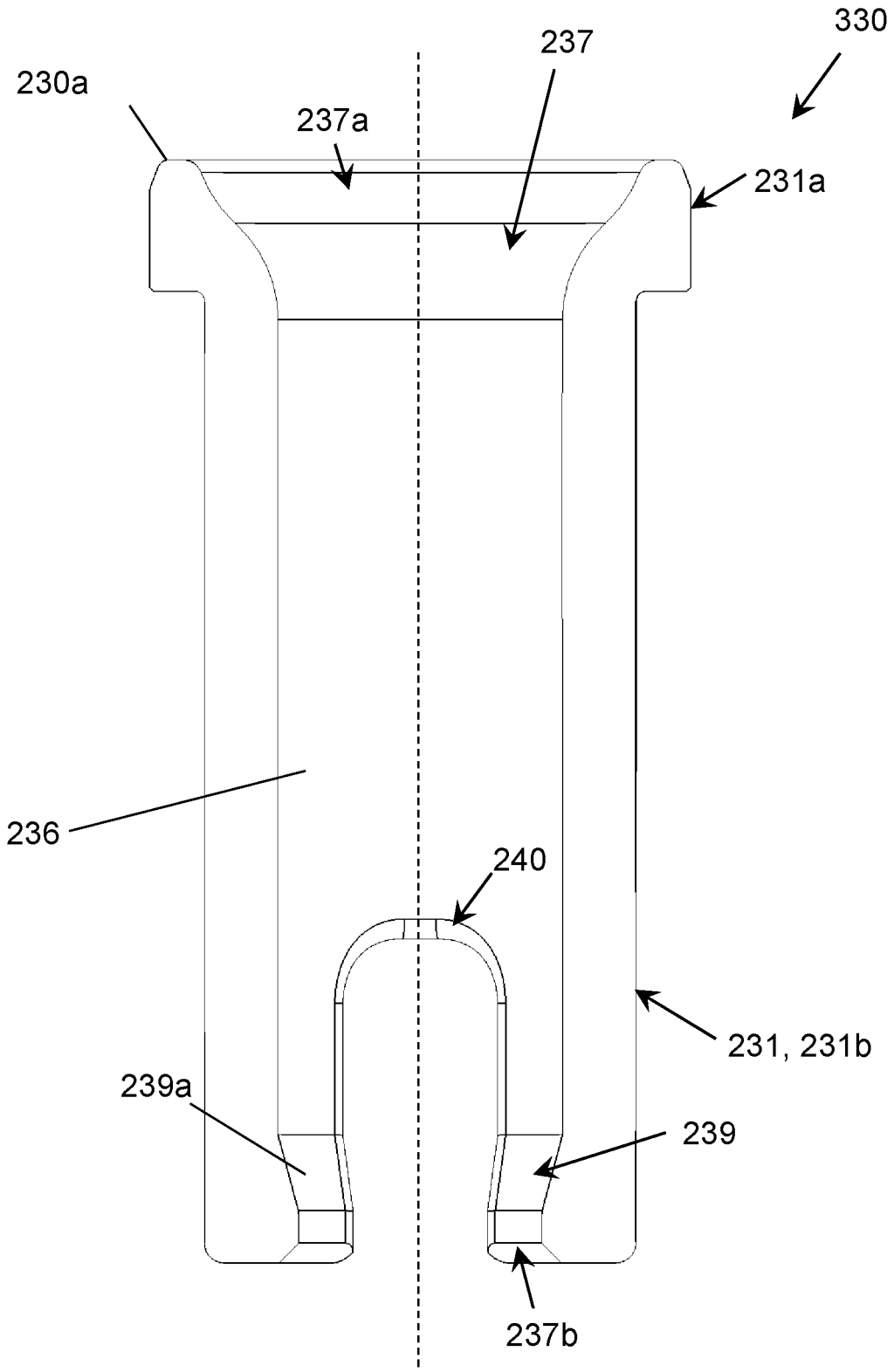
FIG. 15 is a cross-sectional view of the nozzle of FIG. 13 taken in reference plane 15-15 of FIG. 12.
Figure 16:
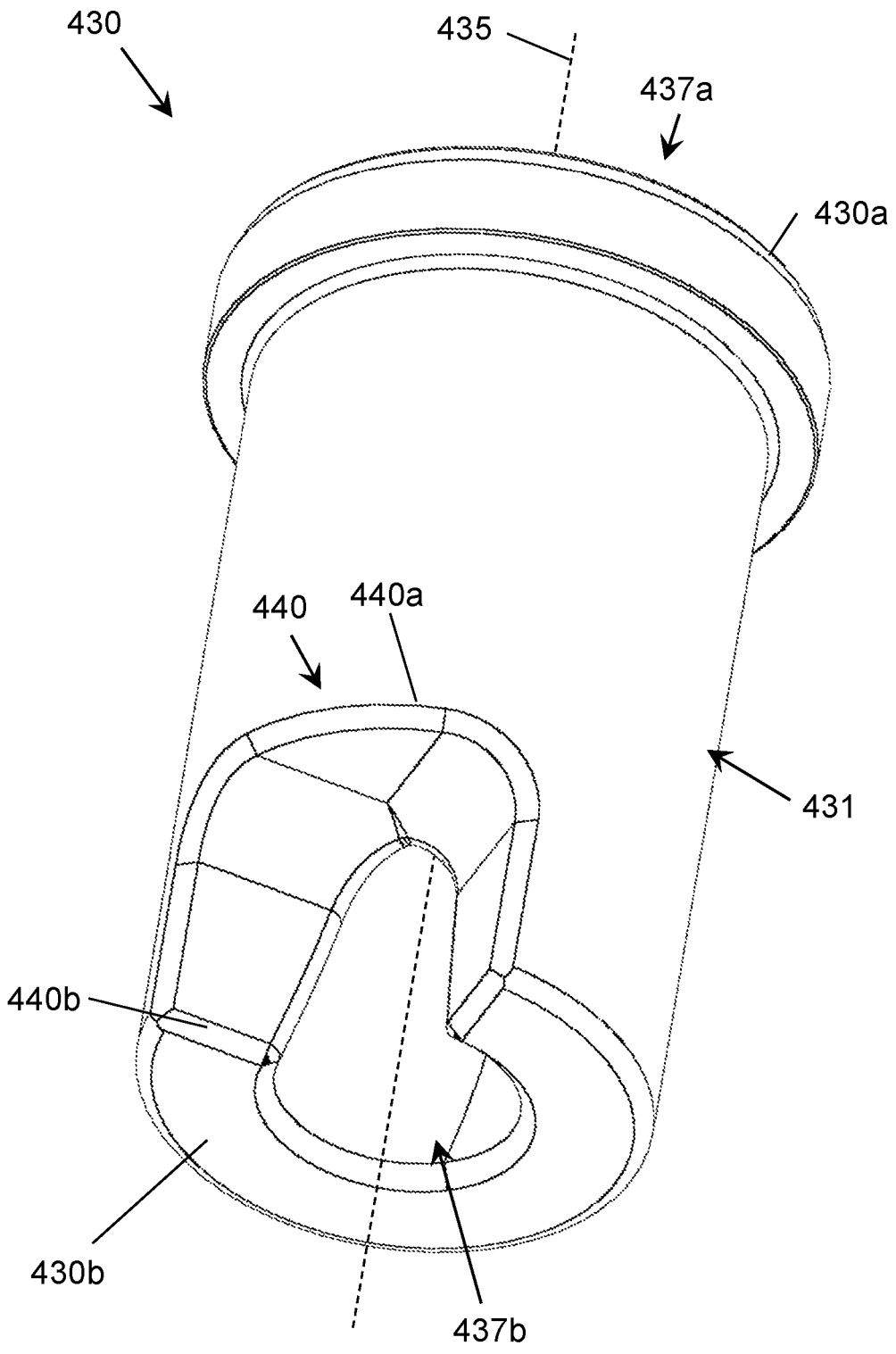
FIG. 16 is a perspective view of an embodiment of a nozzle in accordance with the principles described herein.
Figure 17:
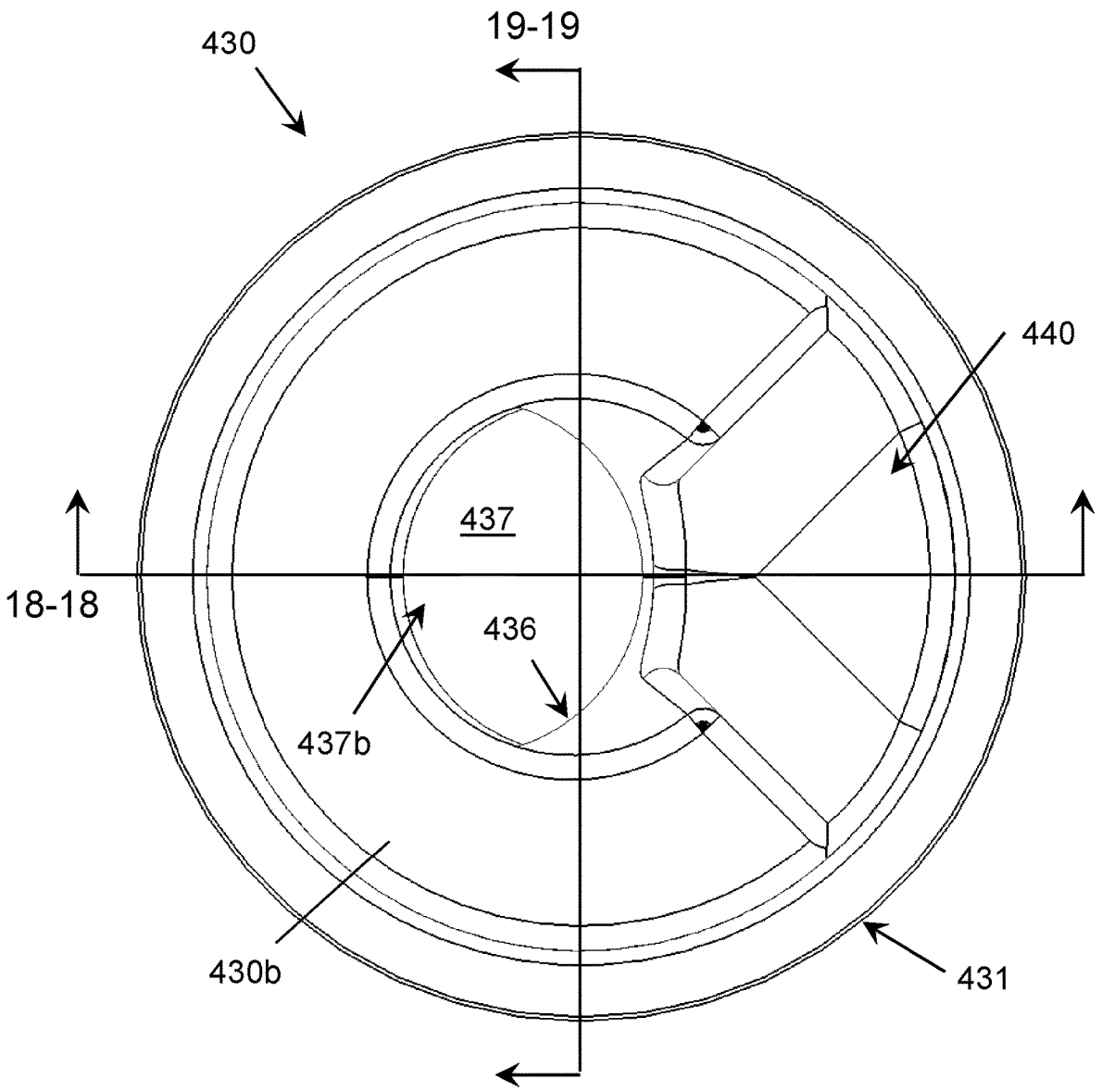
FIG. 17 is an end view of the nozzle of FIG. 16.

In this embodiment, two circumferentially-spaced ports 240 are provided. More specifically, as best shown in FIG. 14, ports 240 are angularly spaced apart (relative to the central axis of nozzle 330) an angle θ measured between the central axes 245 of ports 240. In general, the minimum angle θ between any pair of circumferentially adjacent side ports 240 can be any suitable angle less than or equal to 180°. In this embodiment, angle θ is 180°.

Nozzle 330 is secured to a bit body (e.g., bit body 110) using sleeve 210 in the manner previously described with respect to nozzle assembly 200. In general, nozzle 330 can be positioned and oriented such that side ports 240 direct drilling fluid toward the desired surfaces of the bit face.

In the embodiment of nozzle assembly 200 described above and shown in FIGS. 7-11, a choke 239 is provided along passage 237 to urge at least a portion of the drilling fluid therein to flow radially outward through side outlet 240. However, in other embodiments, features or structures other than chokes can be provided to achieve similar functionality. For example, referring now to FIGS. 16-19, another embodiment of a nozzle 430 that can be used in the place of nozzle 230 previously described is shown. Nozzle 430 is substantially the same as nozzle 230 previously described with the exception that nozzle 430 includes a flow diverter instead of a choke to direct at least a portion of the drilling fluid therein to flow radially outward through a side outlet.

Referring still to FIGS. 16-19, nozzle 430 has a central or longitudinal axis 435, a first or uphole end 430*a*, a second or downhole end 430*b*, a radially outer surface 431 extending axially between ends 430*a*, 430*b*, and a radially inner surface 436 extending axially between ends 430*a*, 430*b*. Outer surface 431 is the same as outer surface 231 of nozzle 230 previously described. Inner surface 436 defines a through passage 437 extending through nozzle 430 from first end 430*a* to second end 430*b*. During drilling operations, drilling fluid enters passage 437 at end 430*a* and exits nozzle 430 at end 430*b*. Accordingly, similar to passage 237 previously described, passage 437 defines a drilling fluid inlet 437*a* at end 430*a* and a drilling fluid outlet 437*b* at end 430*b*.

A side outlet or port 440 extends axially from end 430*b* and extends radially through nozzle 430 from outer surface 431 to inner surface 436. Side port 440 is contiguous with and extends axially from end 430*b* and outlet 437*b*. Thus, side port 440 is in fluid communication with passage 437 and outlet 437*b*. Side outlet 440 has an uphole end 440*a* distal end 430*b* and a downhole end 440*b* at end 430*b*. Side outlet 440 is substantially the same as side outlet 240 previously described with the exception that side outlet 440 is V-shaped instead of U-shaped.

Figure 18:
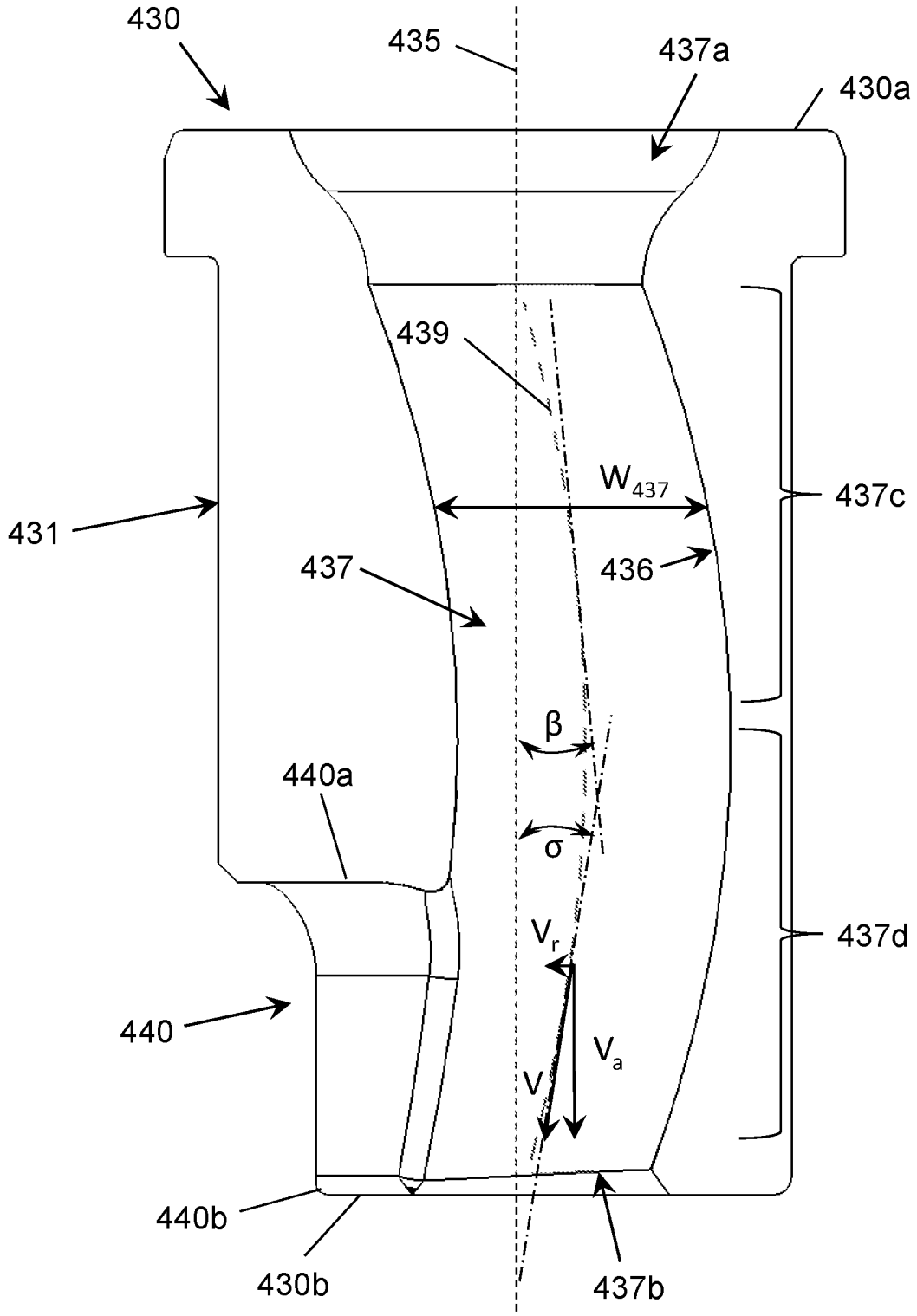
FIG. 18 is a cross-sectional view of the nozzle of FIG. 16 taken in reference plane 18-18 of FIG. 17.

Unlike passage 237, in this embodiment, a choke is not provided along passage 437 for urging at least a portion of drilling fluid toward side outlet 440, and further, passage 437 curves as it extends between ends 430*a*, 430*b*. As best shown in FIG. 18, in a cross-section of nozzle 430 taken in a reference plane 18-18 that contains central axis 435 and bisects side port 440 in end view (FIG. 17), passage 437 has a curved generally C-shaped central or longitudinal axis 439; axes 435, 439 are not coincident or parallel. Consequently, in this view, passage 437 includes a first section or portion 437*c* extending from inlet 437*a* and a second section or portion 437*d* extending from outlet 437*b* to first section 437*c*. First section 437*c* generally curves in a direction away side outlet 440, whereas second section 437*d* generally curves in a direction toward side outlet 440. Thus, tangents to axis 439 in first section 437*c* are oriented at an acute angle β measured upward from axis 435, whereas tangents to axis 439 in second section 437*d* are oriented at an acute angle σ measured downward from axis 435. Passage 437 transitions from the first section 437*c* to second section 437*d* at an axial position disposed between ends 430*a*, 430*b* of nozzle 430, and more specifically, between uphole end 430*a* and side outlet 440. Since second section 437*d* curves toward side outlet 440 as it extends toward downhole end 430*b*, drilling fluid flowing through passage 437 from inlet 437*a* toward outlet 437*b* is simultaneously directed to both outlets 437*b*, 440—the drilling fluid flowing through section 437*d* has a velocity vector V that is tangent to axis 439, and thus, includes a radial velocity component $V_r$ directed toward side outlet 440 and an axial velocity component $V_a$ directed toward outlet 437*b*. It should also be appreciated that in the cross-section of nozzle 430 taken in a reference plane 18-18 (FIG. 18), passage 437 has a width $W_{437}$ measured perpendicular to axis 435 that is generally uniform between inlet 437*a* and outlet 437*b*.

Figure 19:
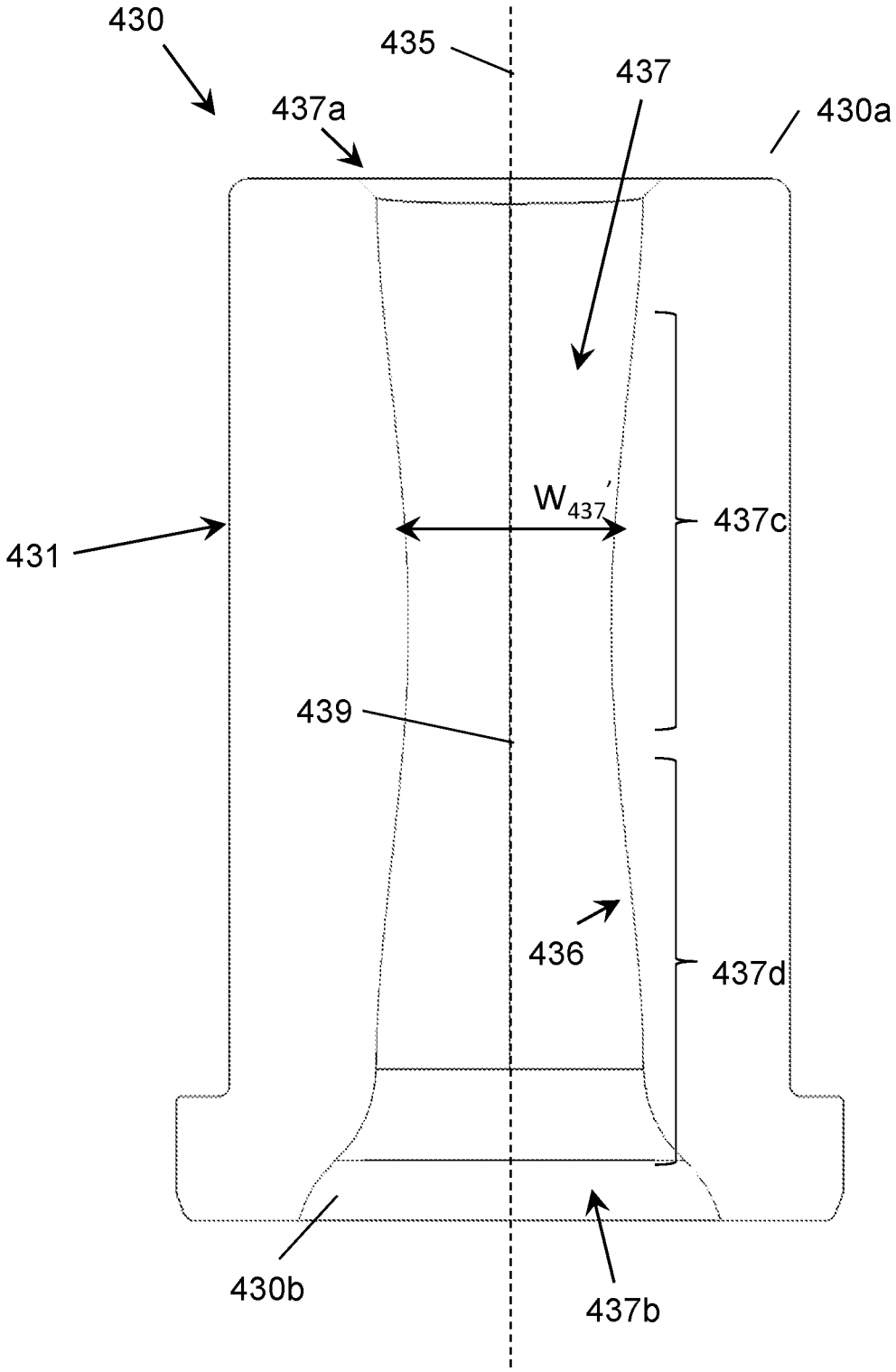
FIG. 19 is a cross-sectional view of the nozzle of FIG. 16 taken in reference plane 19-19 of FIG. 17.

Referring now to FIG. 19, in a cross-section of nozzle 430 taken in a reference plane 19-19 (FIG. 17) that contains central axis 435 and is perpendicular to the reference plane 18-18 that contains central axis 435 and bisects side outlet 440, central axis 439 of passage 437 is linear or straight and passage 437 has an hour-glass shape. More specifically, in this view, passage 437 has a width $W_{437}'$ measured perpendicular to axis 435 that decreases moving along first section 437*c* from end 430*a* to second section 437*d*, and then increases moving along second section 437*d* from first section 437*c* to end 430*b*. As previously described, the transition from section 437*c* to section 437*d* is axially positioned between side outlet 440 and uphole end 430*a*. Consequently, the decreasing width $W_{437}'$ moving along first section 437*c* is uphole of side outlet 440 and does not function to direct drilling fluid toward side outlet 440 in a manner similar to choke 239 previously described, which axially overlaps with side outlet 240.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A drill bit for drilling a borehole in earthen formations, the bit having an uphole end and a downhole end, the bit comprising:

a bit body having a bit axis, a cutting direction of rotation about the bit axis, and bit face disposed at the downhole end, wherein the bit face includes a concave cone region extending radially outward from the bit axis, a convex shoulder region radially adjacent the concave cone region;

wherein the bit face comprises a cutting structure including a plurality of circumferentially-spaced blades and a plurality of cutter elements mounted to the blades in the cone region and the shoulder region, wherein each cutter element has a forward-facing cutting face;

an internal plenum extending from the uphole end into the bit body;

a first flow passage extending from the internal plenum to the bit face;

a nozzle assembly secured to the bit body at a downhole end of the first flow passage in the shoulder region of the bit face, wherein the nozzle assembly is configured to distribute drilling fluid about the shoulder region of the bit face;

wherein the nozzle assembly has a central axis and comprises:

an outer sleeve;

an inner nozzle extending axially through the outer sleeve, wherein the inner nozzle has a first end, a second end opposite the first end, a radially outer surface extending axially from the first end to the second end, and a radially inner surface extending axially from the first end to the second end;

wherein the radially inner surface defines a second flow passage extending axially from the first end to the second end, wherein the second flow passage has an inlet at the first end and an outlet at the second end;

wherein the inner nozzle comprises:

a choke disposed along the second flow passage;

a side outlet extending radially from the radially outer surface to the radially inner surface, and wherein the side outlet extends axially from the outlet at the second end of the inner nozzle;

wherein the second flow passage has a cross-sectional area measured perpendicular to a central axis of the flow passage, wherein the cross-sectional area of the second flow passage decreases moving axially, relative to the central axis of the flow passage, along the choke toward the outlet at the second end of the inner nozzle;

wherein the side outlet extends axially, relative to the central axis of the nozzle assembly, across at least a portion of the choke;

wherein the internal plenum and the first flow passage are configured to flow drilling fluid to the nozzle assembly, and wherein the inner nozzle of the nozzle assembly is oriented with the side outlet configured to direct a portion of the drilling fluid toward the cutting faces of the cutter elements in the shoulder region and the second flow passage configured to direct a portion of the drilling fluid toward a bottom of the borehole.

2. The drill bit of claim 1, wherein the side outlet has a downhole end at the second end of the inner nozzle and an uphole end distal the second end of the inner nozzle, and wherein the uphole end of the side outlet is positioned between the second end of the inner nozzle and the outer sleeve.

3. The drill bit of claim 2, wherein the choke has a downhole end and an uphole end, wherein the downhole end of the choke is axially positioned, relative to the central axis of the nozzle assembly, between the second end of the inner nozzle and the uphole end of the side outlet.

4. The drill bit of claim 3, wherein the downhole end of the choke and the uphole end of the choke are axially positioned, relative to the central axis of the nozzle assembly, between the second end of the inner nozzle and the uphole end of the side outlet.

5. The drill bit of claim 2, wherein the uphole end of the side outlet is positioned between the choke and the outer sleeve.

6. The drill bit of claim 2, wherein the uphole end of the side outlet is disposed at a distance D measured axially, relative to the central axis of the nozzle assembly, from the outer sleeve, wherein the distance D is at least 0.10 in.

7. The drill bit of claim 1, wherein the outer sleeve is threaded into a mating receptacle in the bit face, and wherein the first end of the inner nozzle abuts a shoulder in the receptacle.

8. The drill bit of claim 1, wherein the choke comprises a frustoconical surface along the radially inner surface of the inner nozzle proximal the outlet at the second end of the inner nozzle.

9. The drill bit of claim 1, wherein the side outlet is U-shaped.

10. The drill bit of claim 1, wherein the inner nozzle comprises a plurality of circumferentially-spaced side outlets, wherein each side outlet extends radially, relative to the central axis of the nozzle assembly, from the radially outer surface to the radially inner surface, and wherein each side outlet extends axially, relative to the central axis of the nozzle assembly, from the outlet at the second end of the inner nozzle.

11. The drill bit of claim 1, wherein the side outlet spans an angle β measured about the central axis of the nozzle assembly at the second end of the inner nozzle, wherein the angle β is less than 180°.

12. The drill bit of claim 11, wherein the angle β is 90°.

13. A nozzle assembly for distributing drilling fluid from a drill bit, the nozzle assembly having a central axis and comprising:

a sleeve having a first end, a second end, a radially outer surface extending axially from the first end to the second end, and a radially inner surface extending axially from the first end to the second end, wherein the radially inner surface defines a throughbore extending axially through the sleeve;

a nozzle disposed in the throughbore of the sleeve, wherein the nozzle has a first end proximal the first end of the sleeve, a second end opposite the first end of the nozzle, a radially outer surface extending axially from the first end of the nozzle to the second end of the nozzle, and a radially inner surface extending axially from the first end of the nozzle to the second end of the nozzle;

wherein the radially inner surface of the nozzle defines a flow passage having a central axis and extending axially, relative to the central axis of the nozzle assembly, through the nozzle, wherein the flow passage has an inlet at the first end of the nozzle and an outlet at the second end of the nozzle;

wherein the flow passage includes a choke;

wherein the radially inner surface of the nozzle is disposed at a radius R measured radially from the central axis of the flow passage, wherein moving axially, relative to the central axis of the flow passage, from the first end of the nozzle toward the second end of the nozzle the radius R decreases along the inlet, is constant between the inlet and the choke, and decreases along the choke, wherein the radially inner surface of the nozzle includes a frustoconical surface defining the choke, wherein the frustoconical surface is oriented at an acute angle $\alpha$ relative to the central axis of the flow passage, wherein the acute angle $\alpha$ is between 0° and 20°;

wherein the nozzle includes a side outlet extending radially, relative to the central axis of the nozzle assembly, from the radially outer surface of the nozzle to the radially inner surface of the nozzle, and wherein the side outlet extends axially, relative to the central axis of the nozzle assembly, from the second end and is contiguous with the outlet at the second end of the nozzle;

wherein the choke at least partially overlaps with the side outlet and is configured to direct at least a portion of the drilling fluid flowing through the flow passage toward the side outlet.

14. The nozzle assembly of claim 13, wherein the flow passage has a cross-sectional area measured perpendicular to the central axis of the flow passage, wherein the cross-sectional area of the flow passage decreases moving axially, relative to the central axis of the flow passage, along the choke toward the outlet at the second end of the nozzle.

15. The nozzle assembly of claim 13, wherein the side outlet has a downhole end at the second end of the nozzle and an uphole end distal the second end of the nozzle, and wherein the uphole end of the side outlet is positioned between the second end of the nozzle and the sleeve.

16. The drill bit of claim 15, wherein the choke has a downhole end and an uphole end, wherein the downhole end of the choke is axially positioned, relative to the central axis of the nozzle assembly, between the second end of the nozzle and the uphole end of the side outlet.

17. The drill bit of claim 16, wherein the downhole end of the choke and the uphole end of the choke are axially positioned, relative to the central axis of the nozzle assembly, between the second end of the nozzle and the uphole end of the side outlet.

18. The nozzle assembly of claim 15, wherein the uphole end of the side outlet is positioned between the choke and the sleeve.

19. The nozzle assembly of claim 15, wherein the uphole end of the side outlet is disposed at a distance D measured axially, relative to the central axis of the nozzle assembly, from the sleeve, wherein the distance D is at least 0.10 in.

20. The nozzle assembly of claim 15, wherein the radially outer surface of the sleeve comprises external threads configured to engage mating internal threads of the drill bit.

21. The nozzle assembly of claim 13, wherein the side outlet is U-shaped.

22. The nozzle assembly of claim 13, wherein the radially outer surface of the nozzle slidingly engages the radially inner surface of the sleeve.

23. The nozzle assembly of claim 13, wherein the nozzle comprises a plurality of circumferentially-spaced side outlets, wherein each side outlet extends radially, relative to the central axis of the nozzle assembly, from the radially outer surface to the radially inner surface, and wherein each side outlet extends axially, relative to the central axis of the nozzle assembly, from the second end and the outlet.

24. The nozzle assembly of claim 13, wherein the side outlet spans an angle $\beta$ measured about the central axis of the nozzle assembly at the second end of the nozzle, wherein the angle $\beta$ is less than 180°.

25. The nozzle assembly of claim 24, wherein the angle $\beta$ is 90°.

* * * * *